US011821253B2

(12) United States Patent
Mortland

(10) Patent No.: US 11,821,253 B2
(45) Date of Patent: Nov. 21, 2023

(54) AIRCRAFT DOOR COMMON STOP FITTING

(71) Applicant: The Boeing Company, Chicago, IL (US)

(72) Inventor: Michael T. Mortland, Mukilteo, WA (US)

(73) Assignee: The Boeing Company, Chicago, IL (US)

( * ) Notice: Subject to any disclaimer, the term of this patent is extended or adjusted under 35 U.S.C. 154(b) by 142 days.

(21) Appl. No.: 17/450,137

(22) Filed: Oct. 6, 2021

(65) Prior Publication Data

US 2022/0145685 A1 May 12, 2022

Related U.S. Application Data

(60) Provisional application No. 63/113,008, filed on Nov. 12, 2020.

(51) Int. Cl.

| | |
|---|---|
| ***E05F 5/00*** | (2017.01) |
| ***E05F 5/02*** | (2006.01) |
| ***E05F 5/06*** | (2006.01) |

(52) U.S. Cl.

CPC ..... *E05F 5/025* (2013.01); *E05F 5/06* (2013.01); *E05Y 2201/224* (2013.01); *E05Y 2201/682* (2013.01); *E05Y 2201/706* (2013.01); *E05Y 2600/622* (2013.01); *E05Y 2600/626* (2013.01); *E05Y 2900/502* (2013.01); *E05Y 2900/531* (2013.01)

(58) Field of Classification Search

CPC ..... E05F 5/00; E05F 7/00; E05F 5/025; E05F 5/027; E05F 5/06; E05Y 2201/224; E05Y 2201/682; E05Y 2600/622; E05Y 2600/626; E05Y 2900/502; E05Y 2900/531; E05Y 2201/696; E05Y 2201/70; E05Y 2600/632

See application file for complete search history.

(56) References Cited

U.S. PATENT DOCUMENTS

| | | | | |
|---|---|---|---|---|
| 4,766,643 | A * | 8/1988 | Salazar | E05D 7/105 16/222 |
| 5,241,725 | A | 9/1993 | Hamatani et al. | |
| 7,165,743 | B2 * | 1/2007 | Pasquer | B64D 27/26 60/797 |
| 8,152,094 | B2 * | 4/2012 | Foster | B64D 27/26 244/54 |
| 8,443,612 | B2 * | 5/2013 | Foster | B64D 27/26 244/54 |

(Continued)

*Primary Examiner* — Chi Q Nguyen
(74) *Attorney, Agent, or Firm* — Yee & Associates, P.C.

(57) ABSTRACT

A stop fitting assembly for an aircraft door is presented. The stop fitting assembly comprises a stop fitting, a connecting bracket, and a number of removable fasteners. The stop fitting has a shaft, a flange extending outward from the shaft, and a number of holes extending through the shaft. The connecting bracket has a stop fitting receptacle configured to receive the shaft of the stop fitting, a number of holes extending through walls of the stop fitting receptacle, the connecting bracket configured to be joined to structural members of the aircraft door. The number of removable fasteners is configured to pass through the number of holes in the stop fitting and the number of holes of the stop fitting receptacle to removably join the stop fitting and the connecting bracket.

22 Claims, 20 Drawing Sheets

(56) References Cited

U.S. PATENT DOCUMENTS

| | | | | |
|---|---|---|---|---|
| 9,248,921 | B2 * | 2/2016 | West | B64D 27/18 |
| 10,464,685 | B2 * | 11/2019 | Whiteford | B64D 27/26 |
| 11,072,412 | B2 * | 7/2021 | Jang | B64C 1/18 |
| 2007/0262212 | A1 * | 11/2007 | White | B64D 11/04<br>248/188.4 |
| 2010/0024164 | A1 * | 2/2010 | Machin | E05D 7/121<br>29/434 |
| 2014/0064827 | A1 * | 3/2014 | Korenromp | F16B 2/06<br>403/63 |

* cited by examiner

AIRCRAFT DOOR COMMON STOP FITTING

RELATED PROVISIONAL APPLICATION

This application claims the benefit of U.S. Provisional Patent Application Ser. No. 63/113,008 filed Nov. 12, 2020, and entitled "Aircraft Door Common Stop Fitting" which is incorporated herein by reference in its entirety.

BACKGROUND INFORMATION

1. Field

The present disclosure relates generally to an aircraft door stop, and more specifically to a door stop pin assembly with a common stop fitting.

2. Background

As an aircraft door is closed into a cutout of a fuselage, the door pressure loads are transmitted to the surrounding structure of the cutout in the fuselage. Stop fittings on the aircraft door provide the structural interface between the door structure and the surrounding cutout structure. Conventional stop fittings have greater than desired installation time and complexity.

Therefore, it would be desirable to have a method and apparatus that takes into account at least some of the issues discussed above, as well as other possible issues. For example, it be desirable to provide a stop fitting design with a reduced installation time.

SUMMARY

An embodiment of the present disclosure provides a stop fitting assembly for an aircraft. The stop fitting assembly comprises a stop fitting, a connecting bracket, and a plurality of removable fasteners. The stop fitting has a shaft, a flange extending outward from the shaft, and a number of holes extending through the shaft. The connecting bracket has a stop fitting receptacle configured to receive the shaft of the stop fitting, a number of holes extending through walls of the stop fitting receptacle. The connecting bracket is configured to be joined to structural members of the aircraft door. The plurality of removable fasteners is configured to pass through the number of holes in the stop fitting and the number of holes of the stop fitting receptacle to removably join the stop fitting and the connecting bracket.

Another embodiment of the present disclosure provides a method of installing a stop fitting assembly in an aircraft door. A connecting bracket of the stop fitting assembly is joined to structural members of the aircraft door using permanent fasteners. A shaft of a stop fitting of the stop fitting assembly is inserted into a stop fitting receptacle of the connecting bracket, wherein the stop fitting comprises the shaft, a flange extending outward from the shaft, and a number of holes extending through the shaft. A number of removable fasteners are sent through the number of holes in the stop fitting and a number of holes extending through walls of the stop fitting receptacle of the connecting bracket.

Yet another embodiment of the present disclosure provides a method of maintaining a stop fitting assembly in an aircraft door. Removable fasteners are removed from a number of holes in a first stop fitting of the stop fitting assembly and a number of holes extending through a connecting bracket of the stop fitting assembly. The first stop fitting is removed from the connecting bracket by removing a shaft of the first stop fitting from a stop fitting receptacle of the connecting bracket after removing the removable fasteners from the number of holes in the first stop fitting and the number of holes extending through the connecting bracket. A shaft of a second stop fitting is inserted into the stop fitting receptacle of the connecting bracket, the second stop fitting having a same design as the first stop fitting. A number of removable fasteners is sent through a number of holes in the second stop fitting and the number of holes extending through the connecting bracket.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
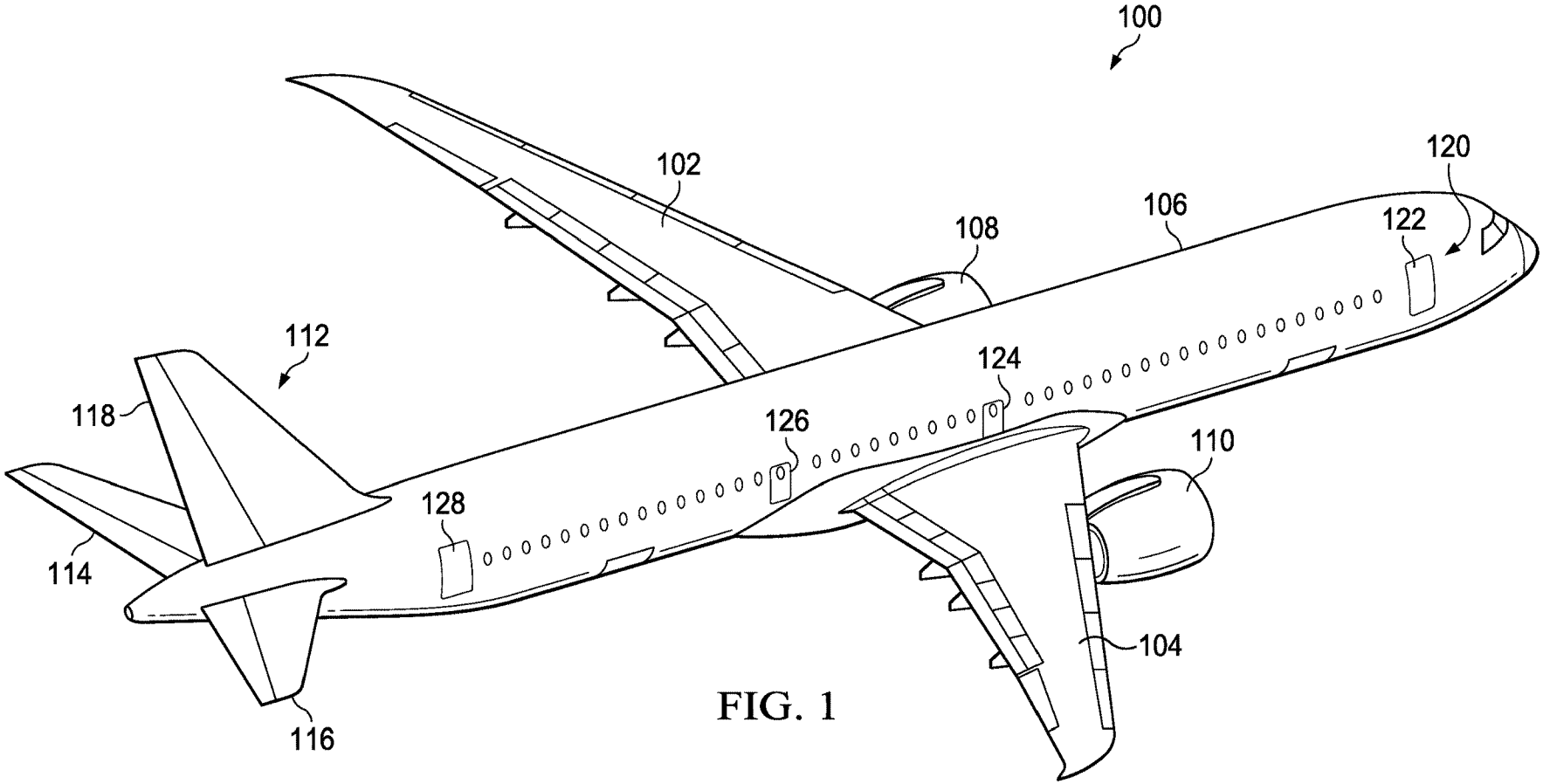
FIG. 1 is an illustration of an aircraft is depicted in accordance with an illustrative embodiment.

The illustrative examples recognize and take into account one or more different considerations. The illustrative examples recognize and take into account that conventional stop fittings each have a unique design for a respective fitting location at each beam end interface. Each conventional stop fitting includes multiple brackets. Each bracket of a conventional stop fitting is affixed with permanent fasteners. Shimming is performed for each of the brackets. The illustrative examples recognize and take into account that initial assembly of conventional stop fittings takes an undesirable amount of time due to part count and shimming.

The illustrative examples recognize and take into account that it would be desirable to utilize fewer unique parts. The illustrative examples recognize and take into account that it would be desirable to utilize common components for all stop fitting locations. The illustrative examples recognize and take into account that installation time could be reduced by reducing a quantity of shims. The illustrative examples recognize and take into account that installation complexity could be reduced by reducing a part count for each stop fitting location. The illustrative examples recognize and take into account that a stop fitting with easily replaceable components is easier to maintain.

The illustrative examples recognize and take into account that maintenance of conventional stop fittings includes drilling out permanent fasteners. The illustrative examples recognize and take into account that maintenance of conventional stop fittings includes removal of multiple components. The illustrative examples recognize and take into account that maintenance time for installation, removal, and replacement of the stop fitting is greater than desired.

The illustrative examples provide a stop fitting assembly for an aircraft. The stop fitting assembly comprises a stop fitting, a connecting bracket, and a number of removable fasteners. The stop fitting has a shaft, a flange extending outward from the shaft, and a number of holes extending through the shaft. The connecting bracket has a stop fitting receptacle configured to receive the shaft of the stop fitting, a number of holes extending through walls of the stop fitting receptacle. The connecting bracket is configured to be joined to structural members of the aircraft door. The number of removable fasteners is configured to pass through the number of holes in the stop fitting and the number of holes of the stop fitting receptacle to removably join the stop fitting and the connecting bracket.

Each of the illustrative examples incorporates a common, easily replaced stop fitting that fits into a single connecting bracket which is rigidly assembled to the door structure. Each stop fitting assembly of the illustrative examples have fewer components than conventional stop fittings. The stop fitting assembly of the illustrative examples will have fewer shims than conventional stop fittings. The illustrative examples will result in a cost savings during each of manufacturing, installation, and maintenance.

Turning now to FIG. 1, an illustration of an aircraft is depicted in accordance with an illustrative embodiment. Aircraft 100 has wing 102 and wing 104 attached to body 106. Aircraft 100 includes engine 108 attached to wing 102 and engine 110 attached to wing 104.

Body 106 has tail section 112. Horizontal stabilizer 114, horizontal stabilizer 116, and vertical stabilizer 118 are attached to tail section 112 of body 106.

A passenger cabin is present in body 106 of aircraft 100. Doors 120 are present in body 106 to provide access to the passenger cabin. Doors 120 include door 122, door 124, door 126, and door 128 in this example. Aircraft 100 is one illustrative example. In other illustrative examples, a design of an aircraft can have at least one of a different quantity of doors, different locations of the doors in body 106, or different designs for the doors.

The passenger cabin is part of a pressure-controlled interior in body 106 of aircraft 100. Each door of doors 120 is an aircraft door to the pressure-controlled interior. Each door of doors 120 can be described as a pressure-controlled aircraft door. Other areas in body 106, such as wheel-well areas, can be non-pressure-controlled. Doors into non-pressure-controlled areas of body 106 are not pressure controlled aircraft doors.

Aircraft 100 is an example of an aircraft in which stop fitting assemblies may be implemented in accordance with an illustrative embodiment. Stop fitting assemblies can be utilized on any desirable pressure-controlled aircraft door in which stop pin pads could be used.

Figure 2:
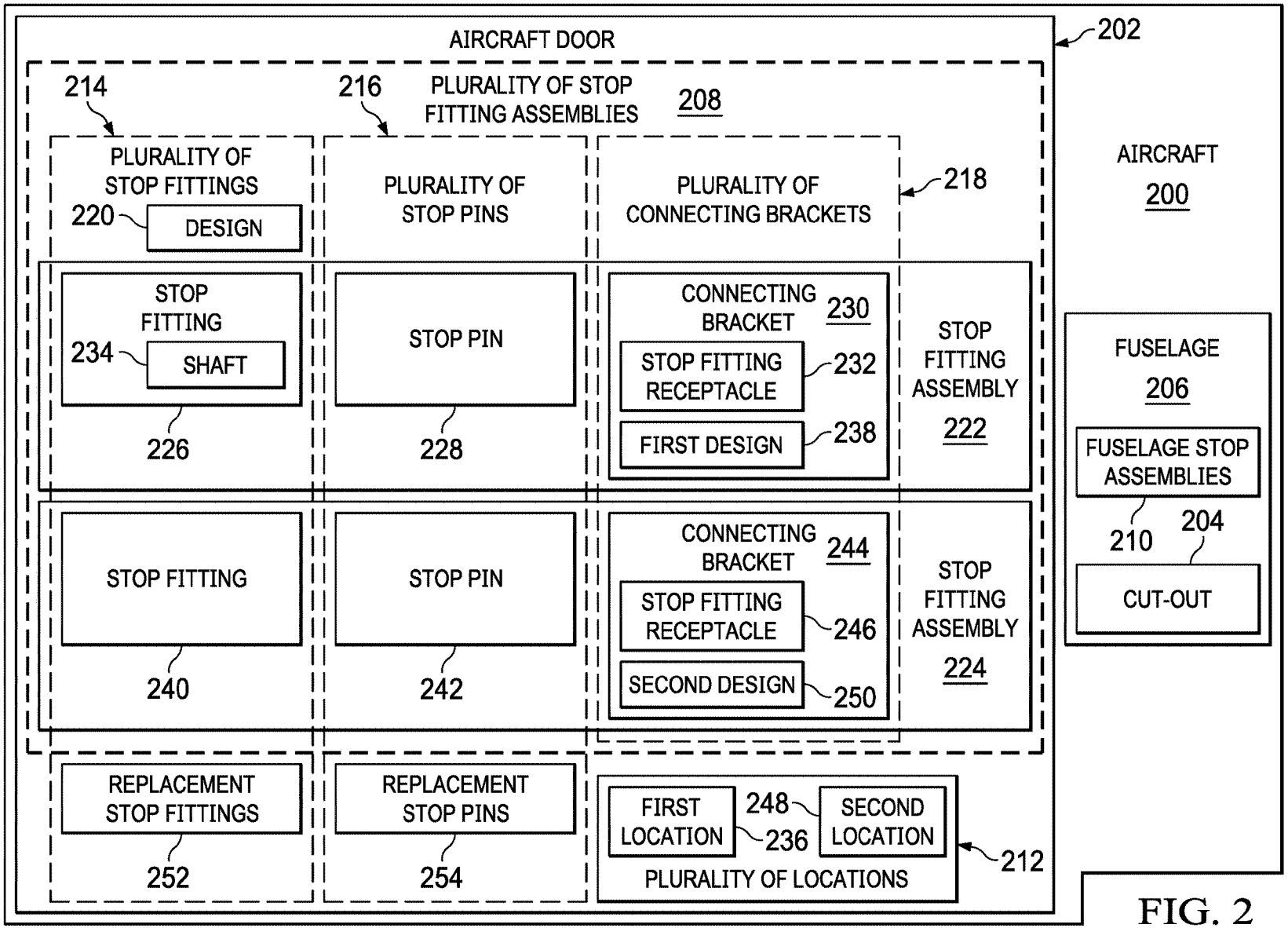
FIG. 2 is an illustration of a block diagram of an aircraft in which an illustrative embodiment may be implemented.

Turning now to FIG. 2, an illustration of a block diagram of an aircraft is depicted in which an illustrative embodiment may be implemented. Aircraft 200 has aircraft door 202 that translates into and out of cut-out 204 of fuselage 206. Aircraft door 202 has plurality of stop fitting assemblies 208 configured to transmit door pressure loads to surround structure of cut-out 204. Plurality of stop fitting assemblies 208 interact with fuselage stop assemblies 210 of fuselage 206 to provide a structural interface between aircraft door 202 and surrounding structure of cut-out 204.

Plurality of stop fitting assemblies 208 is positioned at plurality of locations 212 on aircraft door 202. Plurality of stop fitting assemblies 208 comprises plurality of stop fittings 214, plurality of stop pins 216, and plurality of connecting brackets 218. Each of plurality of stop fittings 214 has design 220. As a result of having a same design, design 220, plurality of stop fittings 214 can be referred to as common stop fittings.

Although plurality of stop fitting assemblies 208 is depicted as having two stop fitting assemblies, plurality of stop fitting assemblies 208 can include any desirable quantity of stop fitting assemblies. As depicted, plurality of stop fitting assemblies 208 includes stop fitting assembly 222 and stop fitting assembly 224.

Stop fitting assembly 222 comprises stop fitting 226, stop pin 228, and connecting bracket 230. Stop fitting 226 has design 220. Stop pin 228 extends through a pin interface hole of stop fitting 226. Connecting bracket 230 has stop fitting receptacle 232 configured to receive shaft 234 of stop fitting 226. Connecting bracket 230 is configured to be joined to structural members of aircraft door 202.

Components of stop fitting assembly 222 are formed of any desirable material. Stop fitting 226 is formed of a metal having sufficient strength. In some illustrative examples, stop fitting 226 is formed of one of steel or titanium. Connecting bracket 230 is formed of a metal having sufficient strength. In some illustrative examples, connecting bracket 230 is formed of one of aluminum or titanium.

Stop fitting assembly 222 will be mounted at first location 236. Each connecting bracket of plurality of connecting brackets 218 has its own respective design based on its mounting location in plurality of locations 212. Connecting bracket 230 has a design, first design 238, selected based on first location 236.

Stop fitting assembly 224 comprises stop fitting 240, stop pin 242, and connecting bracket 244. Stop fitting 240 has design 220. Stop pin 242 extends through a pin interface hole of stop fitting 240. Connecting bracket 244 has stop fitting receptacle 246 configured to receive a shaft of stop fitting 240. Connecting bracket 244 is configured to be joined to structural members of aircraft door 202.

Stop fitting assembly 224 will be mounted at second location 248. Each connecting bracket of plurality of connecting brackets 218 has its own respective design based on its mounting location in plurality of locations 212. Connecting bracket 230 has a design, second design 250, selected based on second location 248.

First design 238 and second design 250 differ based on the design of the structural members present in each of first location 236 and second location 248. First design 238 is selected to minimize shimming between mounting flanges of connecting bracket 230 and structural members at first location 236. Second design 250 is selected to minimize shimming between mounting flanges of connecting bracket 244 and structural members at second location 248.

Although each connecting bracket of plurality of connecting brackets 218 has its own respective design, each connecting bracket has a respective stop fitting receptacle configured to receive a shaft of design 220. Each connecting bracket of plurality of connecting brackets 218 can receive a stop fitting of plurality of stop fittings 214.

As each stop fitting of plurality of stop fittings 214 has a common design, design 220, each of plurality of stop fittings 214 is interchangeable. Each of plurality of stop fittings 214 is configured to be removably connected to a connecting bracket. Stop fitting 226 is removably connected to connecting bracket 230. If stop fitting 226 were to be damaged during operation of aircraft door 202, stop fitting 226 could be replaced with one of replacement stop fittings 252. As each of replacement stop fittings 252 has design 220, replacement stop fittings 252 can be inserted into and removably connected to any connecting bracket of plurality of connecting brackets 218. When a stop fitting is damaged, the stop fitting can be removed and replaced by one of replacement stop fittings 252.

Each stop pin of plurality of stop pins 216 has a common design. Replacement stop pins 254 can be inserted into and removably connected to any stop fitting of plurality of stop fittings 214. In some illustrative examples a stop pin, such as stop pin 228, can be damaged during operation of aircraft door 202. In these illustrative examples, the damaged stop pin can be removed and replaced by one of replacement stop pins 254.

Figure 3:
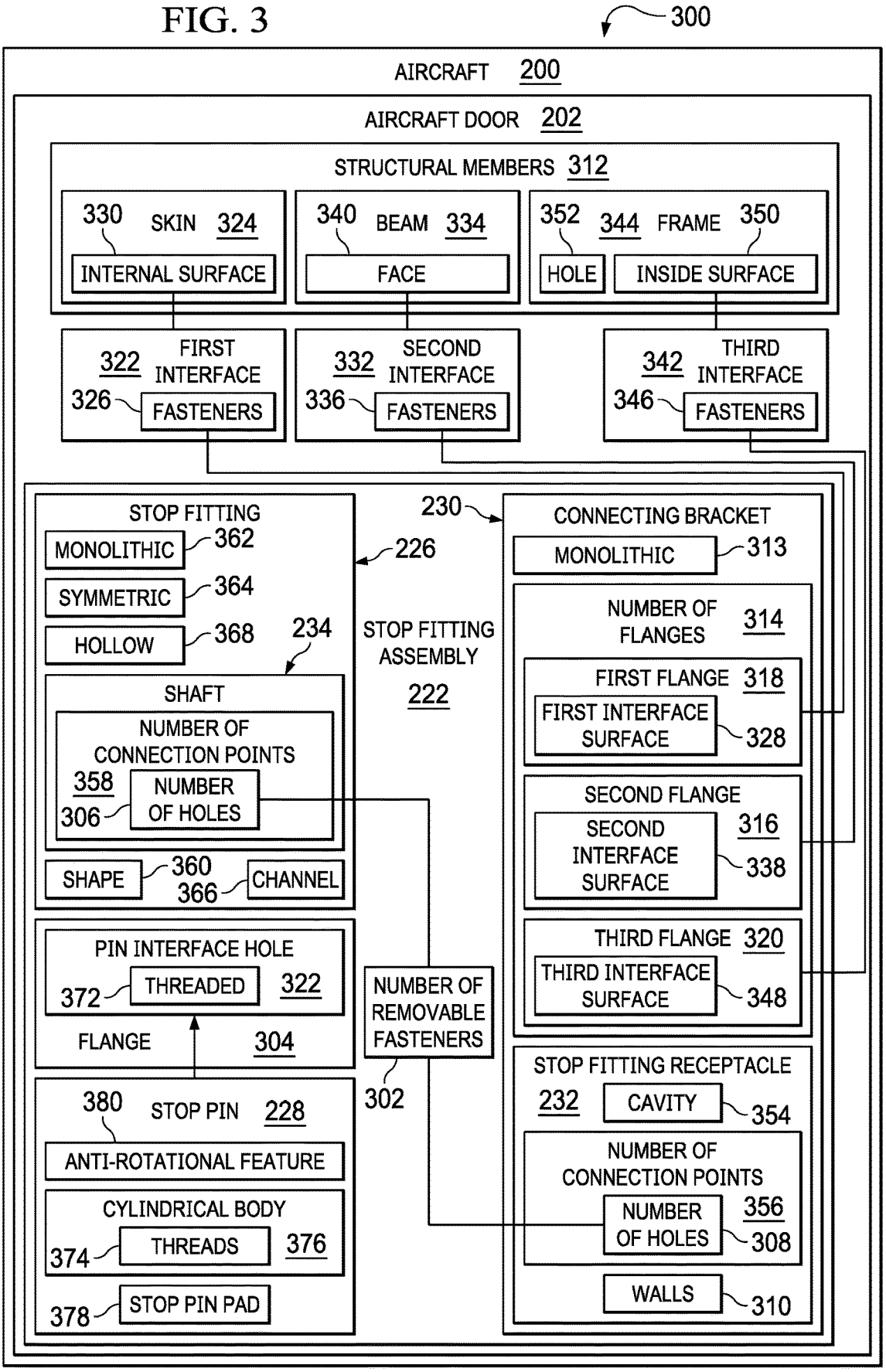
FIG. 3 is an illustration of a block diagram of an aircraft in which an illustrative embodiment may be implemented.

Turning now to FIG. 3, an illustration of a block diagram of an aircraft is depicted in which an illustrative embodiment may be implemented. View 300 of aircraft 200 provides additional detail of connections between stop fitting assembly 222 and aircraft door 202.

Stop fitting assembly 222 for aircraft door 202 comprises stop fitting 226, connecting bracket 230, and number of removable fasteners 302. Stop fitting has shaft 234, flange 304 extending outward from shaft 234, and number of holes 306 extending through shaft 234.

Connecting bracket 230 has stop fitting receptacle 232 configured to receive shaft 234 of stop fitting 226, number of holes 308 extending through walls 310 of stop fitting receptacle 232. Connecting bracket 230 is configured to be joined to structural members 312 of aircraft door 202. Number of removable fasteners 302 is configured to pass through number of holes 306 in stop fitting 226 and number of holes 308 of stop fitting receptacle 232 to removably join stop fitting 226 and connecting bracket 230. In some illustrative examples, connecting bracket 230 is monolithic 313.

Stop fitting assembly 222 further comprises a plurality of permanent fasteners extending through number of flanges 314 of connecting bracket 230 to join stop fitting assembly 222 to aircraft door 202. The plurality of permanent fasteners joins number of flanges 314 to structural members 312.

In this illustrative example, number of flanges 314 includes first flange 316, second flange 318, and third flange 320. First flange 316 is configured to form first interface 322 with skin 324 of aircraft door 202. Fasteners 326 extend through first flange 316 to connect first flange 316 to skin 324. Fasteners 326 are permanent fasteners. First interface surface 328 is configured to contact internal surface 330 of skin 324 to form first interface 322.

Second flange 318 is configured to form second interface 332 with beam 334 of aircraft door 202. Fasteners 336 extend through second flange 318 to connect second flange 318 to beam 334. Fasteners 336 are permanent fasteners. Second interface surface 338 is configured to contact face 340 of beam 334 to form second interface 332.

Third flange 320 is configured to form third interface 342 with frame 344 of aircraft door 202. Fasteners 346 extend through second flange 318 to connect third flange 320 to frame 344. Fasteners 346 are permanent fasteners. Third interface surface 348 is configured to contact inside surface 350 of frame 344 to form third interface 342.

Number of flanges 314 is configured to reduce shimming in aircraft door 202. By designing number of flanges 314 to contact structural members 312, shimming between number of flanges 314 and structural members 312 can be minimized. In some illustrative examples, connecting bracket 230 is monolithic.

Connecting bracket 230 is permanently fastened to structural members 312 of aircraft door 202. Connecting bracket 230 is connected inside of frame 344 of aircraft door 202. Connecting bracket 230 installed in aircraft door 202 is not exposed.

Frame 344 has hole 352. Hole 352 provides access to cavity 354 of stop fitting receptacle 232 from outside of aircraft door 202. To insert shaft 234 into stop fitting receptacle 232, shaft 234 of stop fitting 226 is inserted through hole 352 in frame 344 and into stop fitting receptacle 232 of connecting bracket 230. Stop fitting 226 is exposed outside of frame 344 while being removably connected to connecting bracket 230 permanently connected to and within aircraft door 202.

After inserting shaft 234 into cavity 354, number of removable fasteners 302 is sent through number of holes 308 of stop fitting receptacle 232 to form number of connection points 356. Sending number of removeable fasteners 302 through number of holes 308 also sends number of removable fasteners 302 through number of holes 306 to form number of connection points 358.

Shaft 234 has shape 360 configured to prevent rotation of shaft 234 within cavity 354. Shape 360 can aid in alignment prior to inserting number of removeable fasteners 302. Shape 360 prevents rotation of shaft 234 when number of removable fasteners 302 is not present. Shape 360 takes any desirable form to prevent rotation, such as oval, triangular, rectangular, square, or any other non-circular shape.

In some illustrative examples, stop fitting 226 is monolithic 362. In some illustrative examples, shape 360 is additionally chosen based on machinability of shape 360. In some illustrative examples, shape 360 is selected such that stop fitting 226 is symmetric 364.

It is desirable to have reduced weight for aircraft parts. Increasing weight of aircraft parts can increase fuel consumption or reduce cargo weight in the aircraft. In some illustrative examples, to reduce weight of stop fitting 226, channel 366 extends through shaft 234. In some illustrative examples, when channel 366 extends through shaft 234, stop fitting 226 may be referred to as hollow 368.

Stop pin 228 extends through pin interface hole 370 of flange 304 of stop fitting 226. When aircraft door 202 is closed, stop pin 228 contacts a portion of a fuselage stop assembly, such as one of fuselage stop assemblies 210 of FIG. 2. Stop pin 228 is the contact portion of stop fitting assembly 222. Pin interface hole 370 is threaded 372. Stop pin 228 has threads 374 directly engaging pin interface hole 370. Threads 374 are portions of cylindrical body 376 of stop pin 228. In some illustrative examples, flange 304 with pin interface hole 370 may be referred to as a single eye link.

When stop pin 228 is inserted into pin interface hole 370, cylindrical body 376 is inserted into pin interface hole 370 until stop pin pad 378 is at a desirable location. Stop pin pad 378 remains outside of pin interface hole 370 such that stop pin pad 378 can engage a fuselage stop assembly.

Stop pin 228 is inserted into pin interface hole 370 until portion of cylindrical body 376 is contained in pin interface hole 370 and anti-rotation feature 380 is outside of pin interface hole 370. Anti-rotation feature 380 is on an opposite end of stop pin 228 from stop pin pad 378. When stop pin 228 is installed in stop fitting 226, a portion of cylindrical body 376 is within pin interface hole 370, anti-rotation feature 380 is outside of pin interface hole 370 and is on an opposite side of flange 304 from stop pin pad 378.

Connecting bracket 230 is one of plurality of connecting brackets 218 of FIG. 2 for plurality of stop fitting assemblies 208 of aircraft door 202. Each connecting bracket of plurality of connecting brackets 218 of FIG. 2 has a respective design for a select location on aircraft door 202. Stop fitting 226 is one of plurality of stop fittings 214 for plurality of stop fitting assemblies 208 of aircraft door 202. Each of plurality of stop fittings 214 has a same design, design 220.

To perform maintenance on stop fitting assembly 222, at least one of stop pin 228 or stop fitting 226 can be removed and replaced. In some illustrative examples, stop pin 228 has undesirable wear or damage from operation of aircraft door 202. In these illustrative examples, a wire can be removed from anti-rotation feature 380 and stop pin 228 removed from flange 304 of stop fitting 226. A stop pin with a same design is then inserted into pin interface hole 370. The stop pin can be one of replacement stop pins 254 of FIG. 2.

In some illustrative examples, stop fitting 226 can be damaged from operation of aircraft door 202. In these illustrative examples, number of removable fasteners 302 are removed from connecting bracket 230 and stop fitting 226. Stop fitting 226 is removed from stop fitting receptacle 232. Afterwards a second stop fitting with the same design is inserted into stop fitting receptacle 232. The second stop fitting can be one of replacement stop fittings 252 of FIG. 2. The second stop fitting is then connected to connecting bracket 230 by removable fasteners. The removable fasteners could be number of removable fasteners 302 or another set of removable fasteners.

In some illustrative examples, when the second stop fitting is inserted into stop fitting receptacle 232, a stop pin is already joined to the new stop fitting. In other illustrative examples, a stop pin is inserted into the second stop fitting after the second stop fitting is connected to connecting bracket 230 by removable fasteners, such as number of removable fasteners 302.

In some illustrative examples, stop pin 228 is removed from stop fitting 226 prior to removal of stop fitting 226. In some illustrative examples stop pin 228 and stop fitting 226 are removed from connecting bracket 230 while stop pin 228 and stop fitting 226 are joined.

The illustrations of aircraft 200 in FIGS. 2 and 3 are not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, although only two stop fitting assemblies are depicted, any desirable quantity of stop fitting assemblies can be present in plurality of stop fitting assemblies 208. Additionally, although only one aircraft door, aircraft door 202, is depicted in FIGS. 2 and 3, any desirable quantity of aircraft doors in aircraft 200 can include stop fitting assemblies of the illustrative examples.

Figure 4:
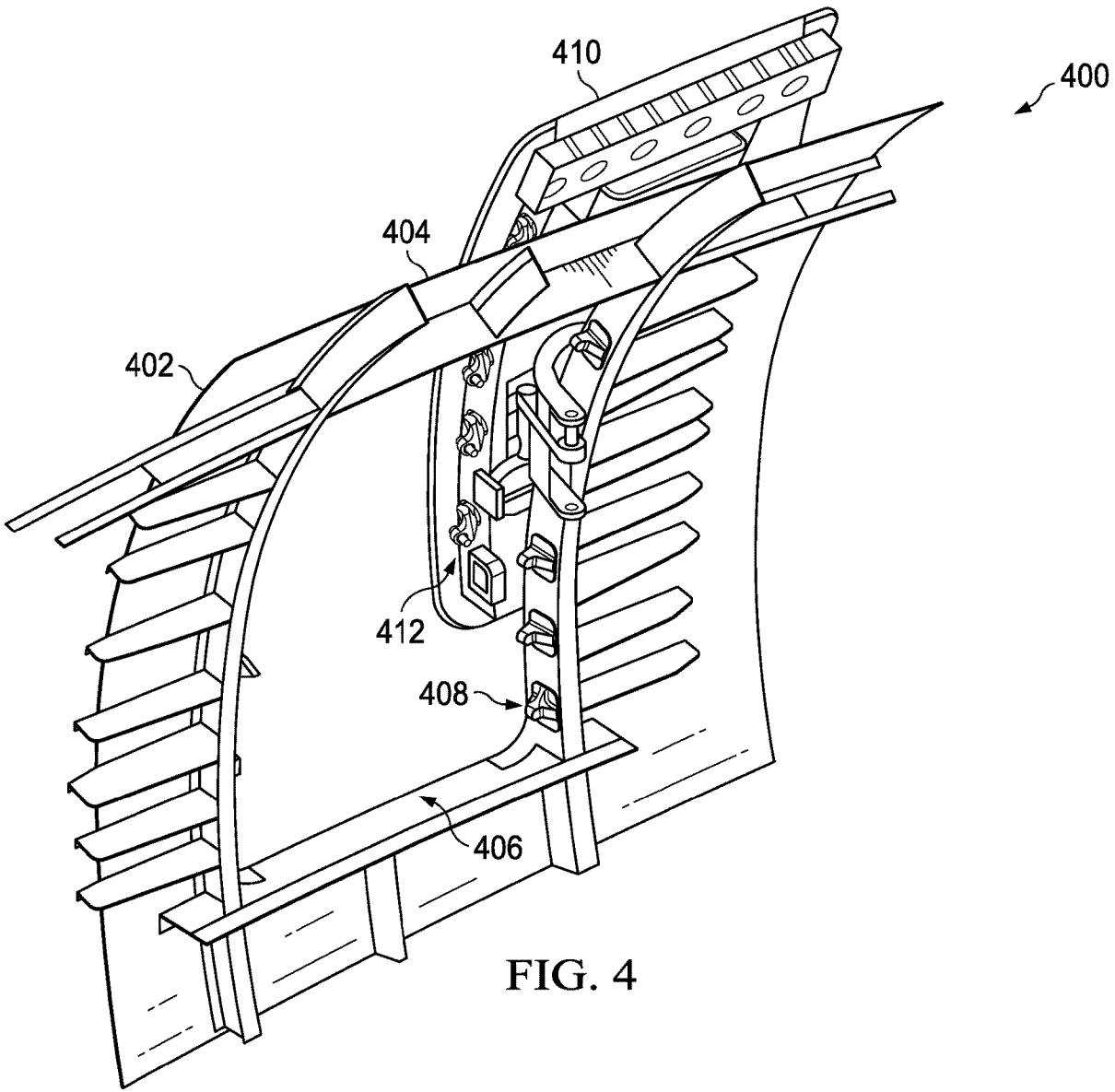
FIG. 4 is an illustration of an aircraft door in an open position relative to a door cutout in accordance with an illustrative embodiment.

Turning now to FIG. 4, an illustration of an aircraft door in an open position relative to a door cutout is depicted in accordance with an illustrative embodiment. View 400 is a cutaway view from an interior of an aircraft, such as aircraft 100 of FIG. 1 or aircraft 200 of FIGS. 2 and 3. Fuselage 402 of aircraft 404 is a physical implementation of fuselage 206 of FIG. 2. Fuselage 402 can be a portion of body 106 of FIG. 1.

Fuselage 402 has cutout 406. Cutout 406 has plurality of fuselage stop assemblies 408. In view 400, aircraft door 410 is in an open position. Plurality of fuselage stop assemblies 408 and plurality of stop fitting assemblies 412 are visible in view 400. When aircraft door 410 is closed, plurality of stop fitting assemblies 412 transfer loads into fuselage 402 through fuselage stop assemblies 408.

Figure 5:
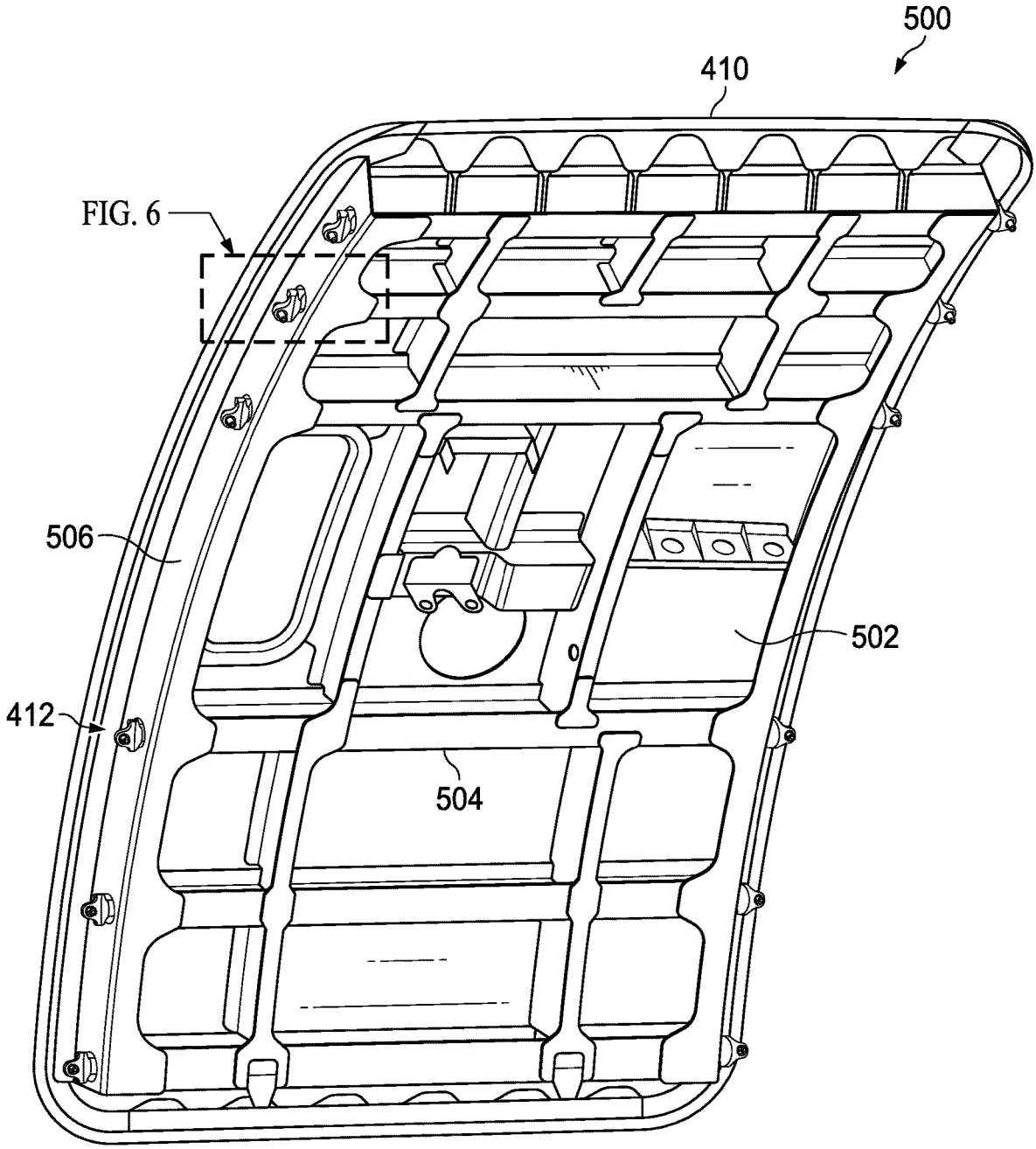
FIG. 5 is an illustration of an aircraft door with aircraft door common stop fittings in accordance with an illustrative embodiment.

Turning now to FIG. 5, an illustration of an aircraft door with aircraft door common stop fittings is depicted in accordance with an illustrative embodiment. View 500 is a view of aircraft door 410 without fuselage 402. In view 500 decorative components that obscure components of aircraft door 410 from passengers are not present.

Several structural components of aircraft door 410 are visible in view 500, including skin 502, beams 504, and frames 506. Plurality of stop fitting assemblies 412 are connected to the structural components of aircraft door 410.

Figure 6:
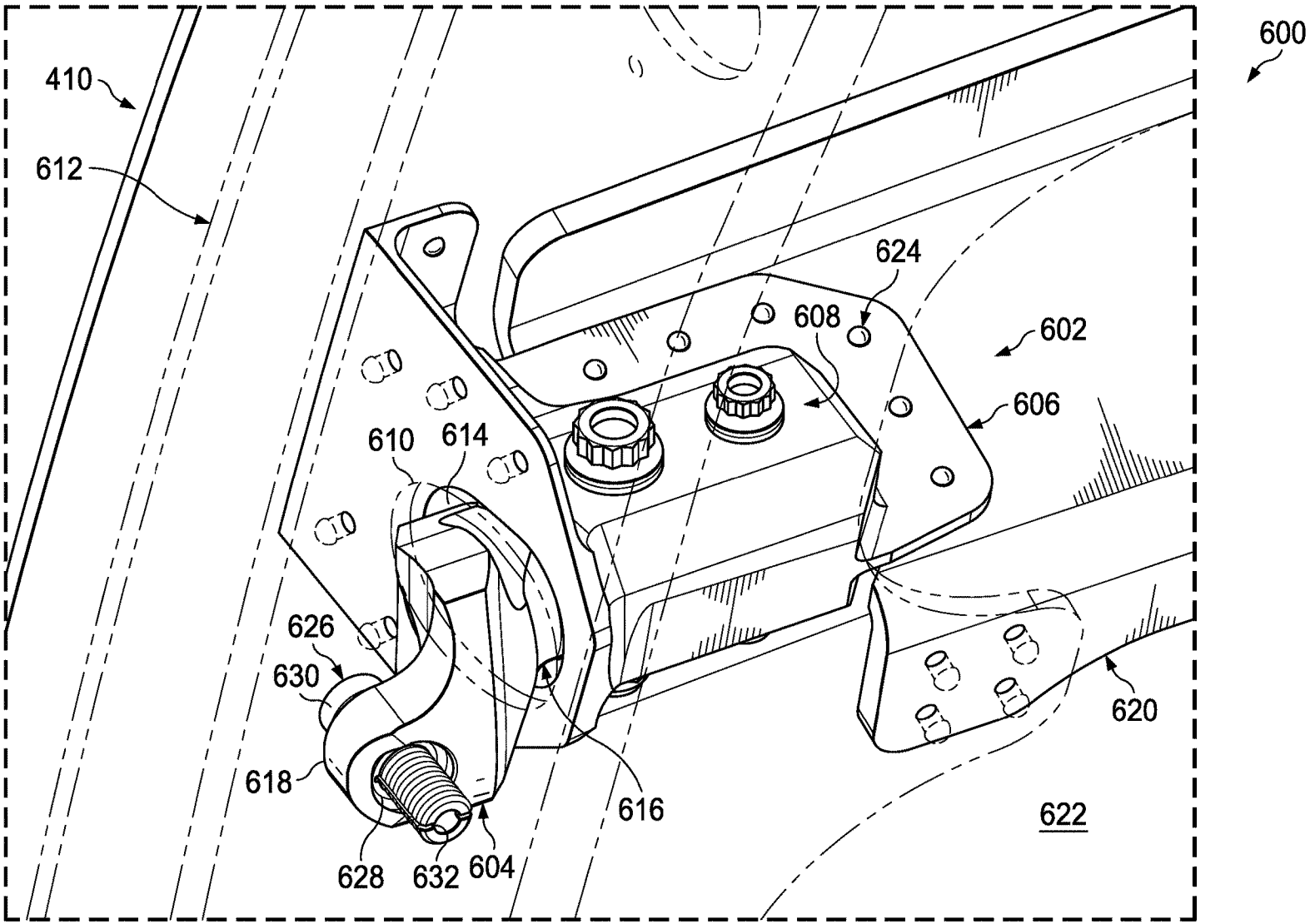
FIG. 6 is an illustration of a partially phantom view of a stop fitting assembly with a common stop fitting in an aircraft door in accordance with an illustrative embodiment.

Turning now to FIG. 6, an illustration of a partially phantom view of a stop fitting assembly with a common stop fitting in an aircraft door is depicted in accordance with an illustrative embodiment. View 600 is a view within box 6 of FIG. 5. View 600 is a view of one stop fitting assembly of plurality of stop fitting assemblies 412.

Stop fitting assembly 602 comprises stop fitting 604, connecting bracket 606, and number of removable fasteners 608. Stop fitting 604 extends through hole 610 in frame 612 and into stop fitting receptacle 614 of connecting bracket 606.

Stop fitting 604 has shaft 616 and flange 618 extending outward from shaft 616. Connecting bracket 606 has stop fitting receptacle 614 configured to receive shaft 616 of stop fitting 604.

Connecting bracket 606 is configured to be joined to structural members of aircraft door 410. As depicted, connecting bracket 606 is connected to frame 612, beam 620, and skin 622 of aircraft door 410. Connecting bracket 606 is connected to structural members of aircraft door 410 using permanent fasteners 624. Permanent fasteners 624 extend through a number of flanges of connecting bracket 606 to join stop fitting assembly 602 to aircraft door 410.

Stop fitting assembly 602 also includes stop pin 626 extending through pin interface hole 628 of flange 618 of stop fitting 604. Stop pin 626 has stop pin pad 630 configured to contact a fuselage stop assembly. Stop pin 626 has anti-rotation feature 632. Stop pin pad 630 and anti-rotation feature 632 are on opposite sides of flange 618.

In this illustrative example, anti-rotation feature 632 takes the form of a cut through a portion of stop pin 626. In this illustrative example, after inserting stop pin 626 into flange 618, a wire can be inserted into anti-rotation feature 632 to prevent rotation of stop pin 626. The wire and the anti-rotation feature 632 prevent unintentional removal of stop pin 626.

To perform maintenance on stop fitting assembly 602, at least one of stop pin 626 or stop fitting 604 can be removed and replaced. In some illustrative examples, stop pin 626 has undesirable wear or damage from operation of aircraft door 410. In these illustrative examples, the wire can be removed from anti-rotation feature 632 and stop pin 626 removed from flange 618 of stop fitting 604. A stop pin with a same design is then inserted into pin interface hole 628.

In some illustrative examples, stop fitting 604 can be damaged from operation of aircraft door 410. In these illustrative examples, removable fasteners 608 are removed from connecting bracket 606 and stop fitting 604. Stop fitting 604 is removed from stop fitting receptacle 614. Afterwards a stop fitting with the same design is inserted into stop fitting receptacle 614. The stop fitting is then connected to connecting bracket 606 by removable fasteners. The removable fasteners could be number of removable fasteners 608 or another set of removable fasteners.

In some illustrative examples, when the new stop fitting is inserted into stop fitting receptacle 614, a stop pin is already joined to the new stop fitting. In other illustrative examples, a stop pin is inserted into the new stop fitting after the new stop fitting is connected to connecting bracket 606 by removable fasteners, such as number of removable fasteners.

In some illustrative examples, stop pin 626 is removed from stop fitting 604 prior to removal of stop fitting 604. In some illustrative examples stop pin 626 and stop fitting 604 are removed from connecting bracket 606 while stop pin 626 and stop fitting 604 are joined.

Figure 7:
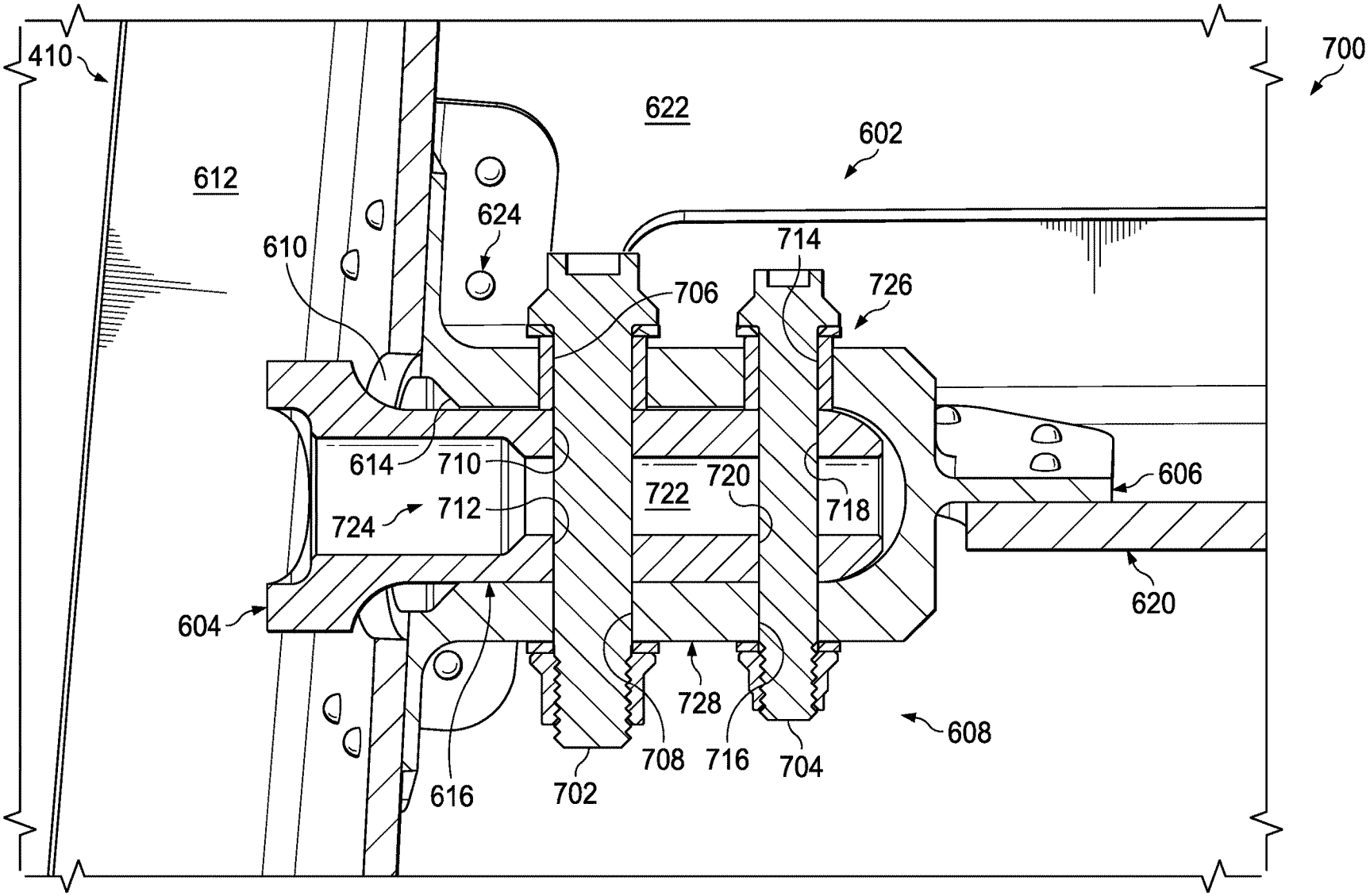
FIG. 7 is an illustration of a side cross-sectional view of a stop fitting assembly with a common stop fitting in an aircraft door in accordance with an illustrative embodiment.

Turning now to FIG. 7, an illustration of a side cross-sectional view of a stop fitting assembly with a common stop fitting in an aircraft door is depicted in accordance with an illustrative embodiment. View 700 is a cross-sectional view from direction 7 in FIG. 6. In view 700, removeable fasteners 608 are visible extending through connecting bracket 606 and stop fitting 604. As depicted, removable fasteners 608 include removable fastener 702 and removable fastener 704.

Removable fastener 702 extends through hole 706 and hole 708 of connecting bracket 606. Removable fastener 702 extends through hole 710 and hole 712 of stop fitting 604. Removable fastener 704 extends through hole 714 and hole 716 of connecting bracket 606. Removable fastener 704 extends through hole 718 and hole 720 of stop fitting 604. By removable fastener 702 extending completely through stop fitting 604 and stop fitting receptacle 614, removable fastener 702 is easily accessed for removal. By removable fastener 704 extending completely through stop fitting 604 and stop fitting receptacle 614, removable fastener 702 is easily accessed for removal.

As depicted, shaft 616 of stop fitting 604 is hollow. More specifically, stop fitting 604 further comprises channel 722 extending through shaft 616 of stop fitting 604. Number of removable fasteners 608 extends through number of holes 724 extending through shaft 616 and number of holes 726 extending through walls 728 of stop fitting receptacle 614 to removably join stop fitting 604 and connecting bracket 606. Number of holes 724 includes hole 710, hole 712, hole 718, and hole 720. Number of holes 726 includes hole 706, hole 708, hole 714, and hole 716.

Figure 8:
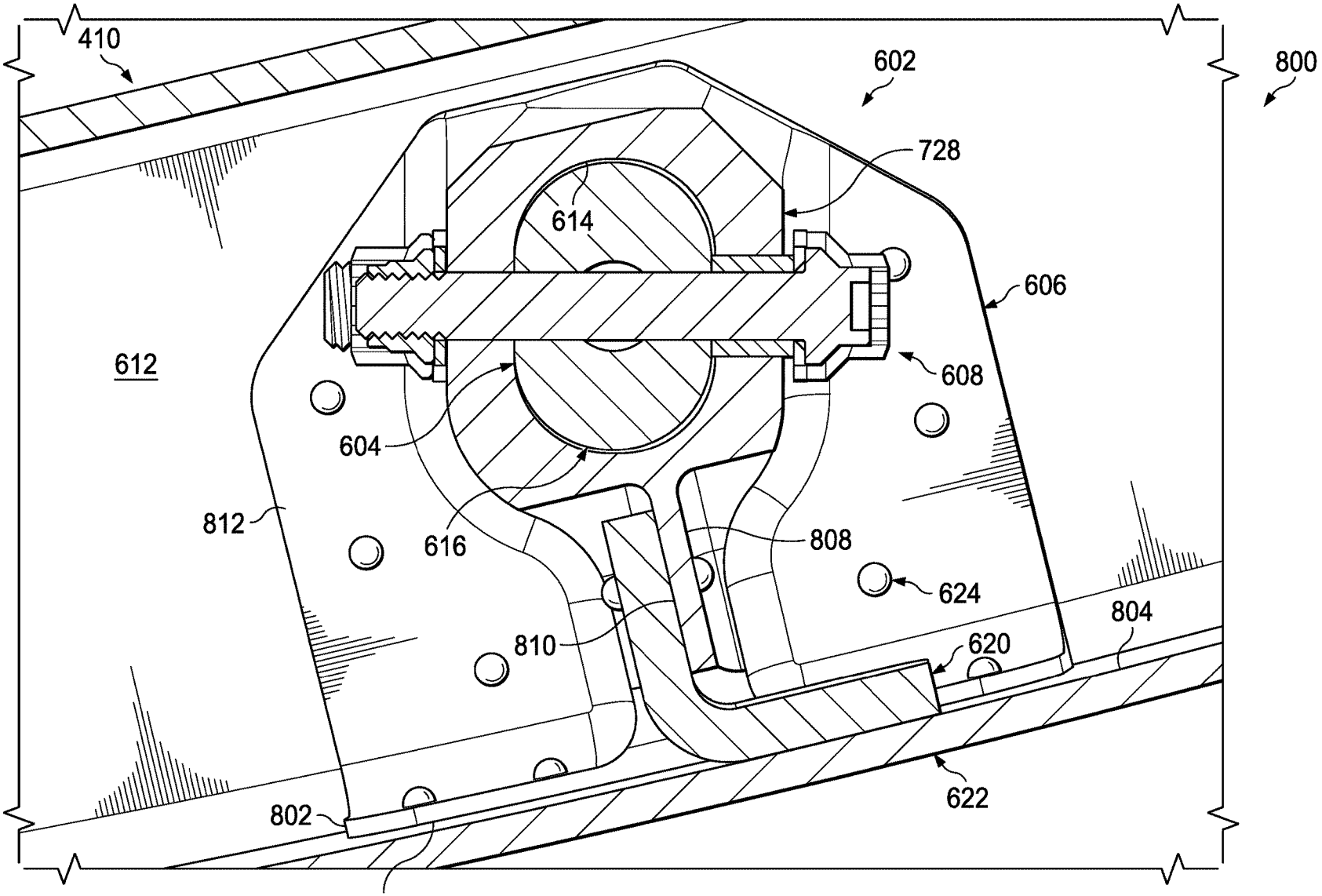
FIG. 8 is an illustration of a back cross-sectional view of a stop fitting assembly with a common stop fitting in an aircraft door in accordance with an illustrative embodiment.

Turning now to FIG. 8, an illustration of a back cross-sectional view of a stop fitting assembly with a common stop fitting in an aircraft door is depicted in accordance with an illustrative embodiment. In view 800 the interfaces between some flanges of connecting bracket 606 and the structural supports of aircraft door 410 are visible.

First flange 802 of connecting bracket 606 is connected to inner surface 804 of skin 622 to form first interface 806. Second flange 808 of connecting bracket 606 is connected to beam 620 to form second interface 810. Third flange 812 of connecting bracket 606 is connected to frame 612 to form a third interface. By using a single connecting bracket, connecting bracket 606, stop fitting assembly 602 reduces a quantity of shims used to install connecting bracket 606 compared to a conventional stop fitting.

Figure 9:
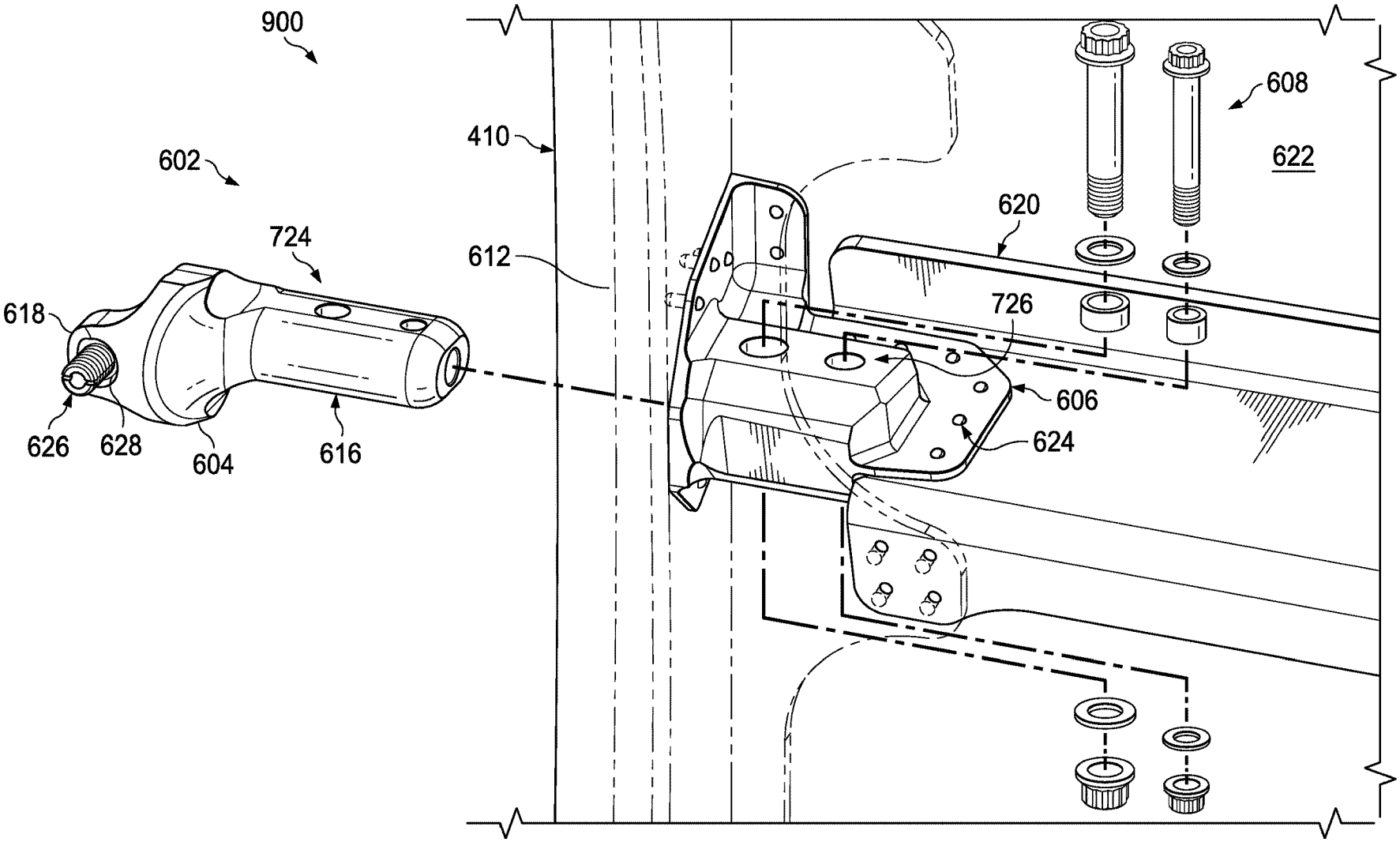
FIG. 9 is an illustration of an exploded view of a stop fitting assembly with a common stop fitting in an aircraft door in accordance with an illustrative embodiment.

Turning now to FIG. 9, an illustration of an exploded view of a stop fitting assembly with a common stop fitting in an aircraft door is depicted in accordance with an illustrative embodiment. View 900 is an exploded view of stop fitting assembly 602. In view 900, number of removable fasteners 608 have been removed from connecting bracket 606 and stop fitting 604. By removing number of removable fasteners 608, stop fitting 604 is free to be removed from stop fitting receptacle 614 of connecting bracket 606.

Connecting bracket 606 is permanently fastened inside of frame 612. Connecting bracket 606 does not extend into the interface between aircraft door 410 and cutout 406. During maintenance of stop fitting assembly 602, connecting bracket 606 remains connected to aircraft door 410.

During maintenance of stop fitting assembly 602, stop fitting 604 can be removed and replaced. By removing number of removable fasteners 608, stop fitting 604 can be removed from connecting bracket 606. Use of number of removable fasteners 608 and stop fitting 604 reduces maintenance time relative to conventional stop fittings.

Figure 10:
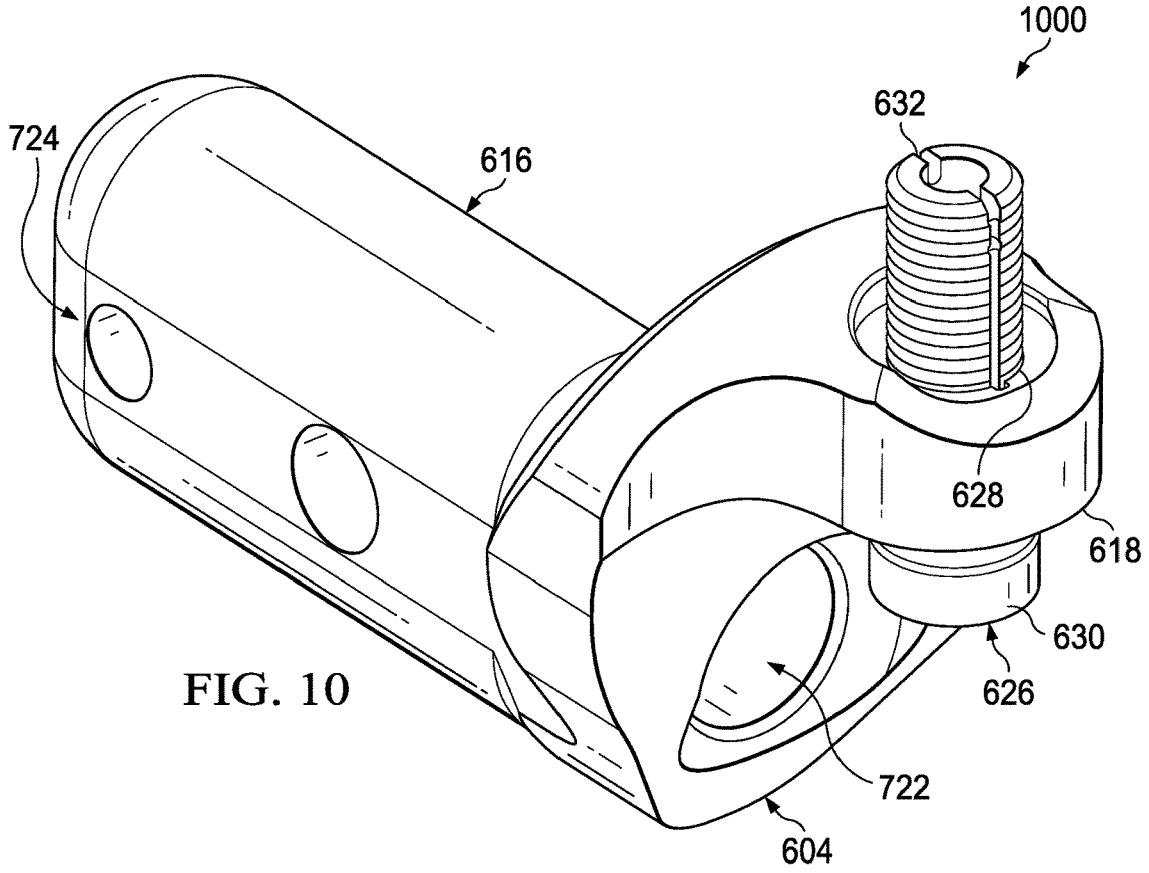
FIG. 10 is an illustration of a common stop fitting and a stop pin in accordance with an illustrative embodiment.

Turning now to FIG. 10, an illustration of a common stop fitting and a stop pin is depicted in accordance with an illustrative embodiment. View 1000 is a view of stop fitting 604 and stop pin 626 without aircraft door 410 or connecting bracket 606. Channel 722 is visible in view 1000. Channel 722 is present in stop fitting 604 to reduce the weight of stop fitting 604 when compared to a stop fitting having the same shape without channel 722.

Anti-rotation feature 632 of stop pin 626 is more clearly visible in view 1000. As can be seen in view 1000, stop pin 626 extends through pin interface hole 628. Stop pin 626 directly interacts with stop fitting 604.

Figure 11:
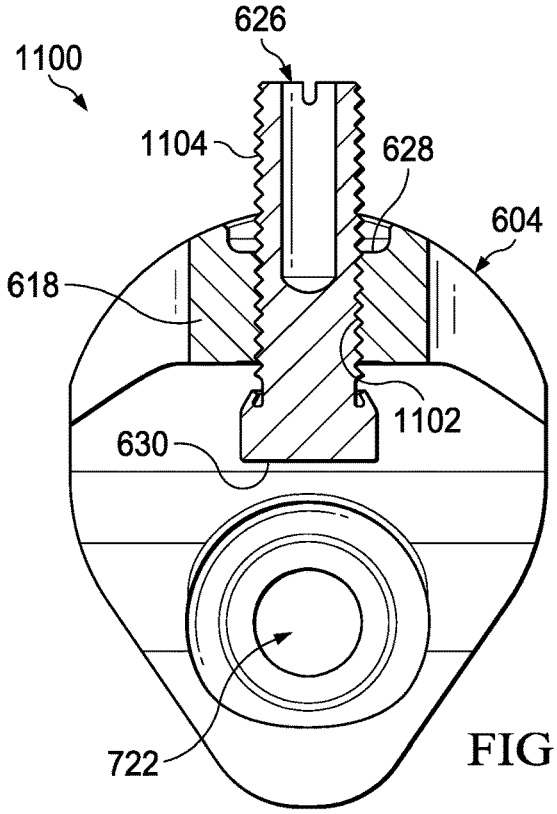
FIG. 11 is an illustration of a front cross-sectional view of common stop fitting and a stop pin in accordance with an illustrative embodiment.

Turning now to FIG. 11, an illustration of a front cross-sectional view of common stop fitting and a stop pin is depicted in accordance with an illustrative embodiment. In view 1100, threads 1102 of pin interface hole 628 in flange 618 are visible. Threads 1104 of stop pin 626 are also visible. As depicted, stop pin 626 has threads 1104 directly engage pin interface hole 628.

Figure 12:
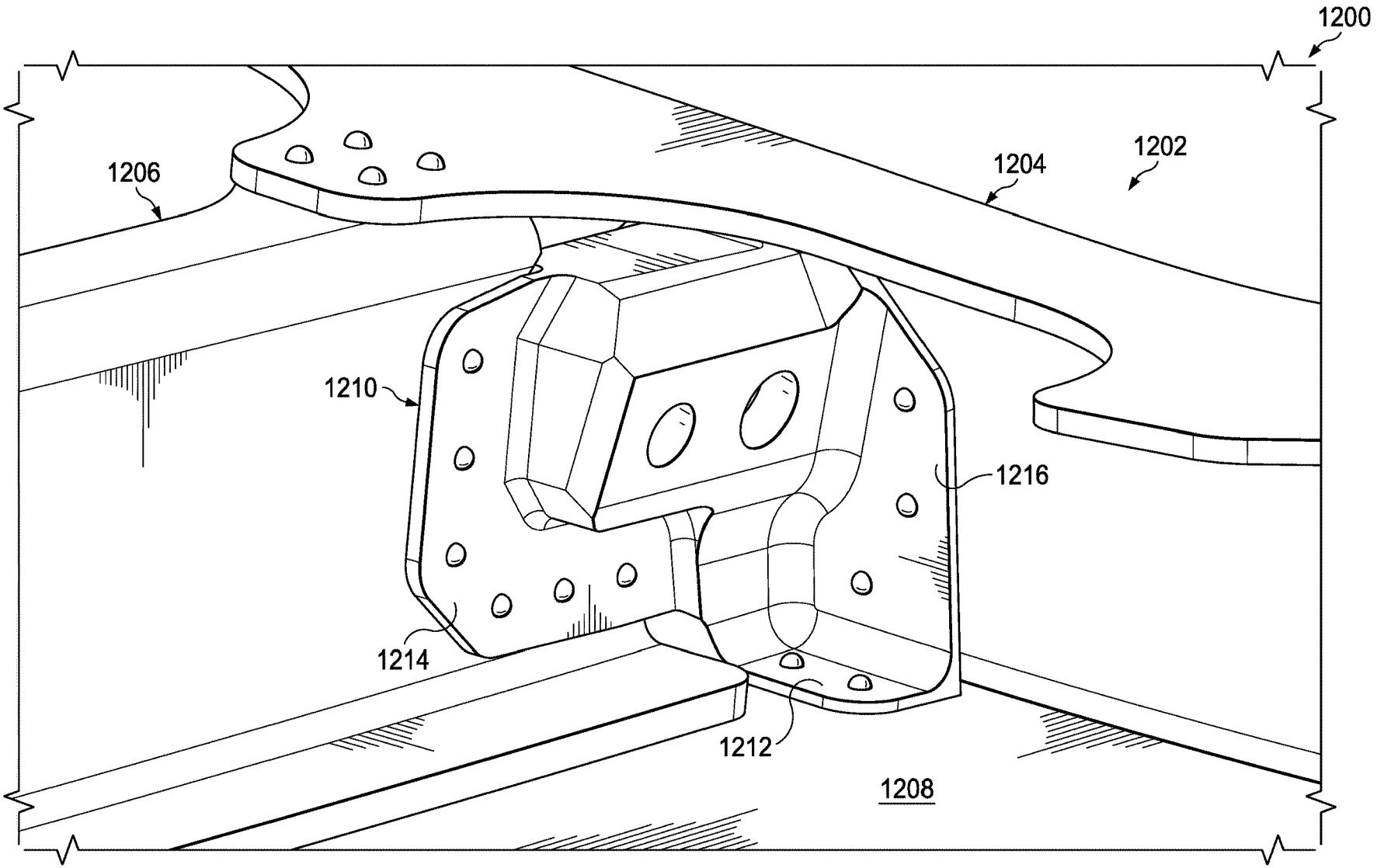
FIG. 12 is an illustration of an isometric view of a connecting bracket in an aircraft door in accordance with an illustrative embodiment.

Turning now to FIG. 12, an illustration of an isometric view of a connecting bracket in an aircraft door is depicted in accordance with an illustrative embodiment. In view 1200, aircraft door 1202 has frame 1204, beam 1206, and skin 1208. Connecting bracket 1210 is connected to each of frame 1204, beam 1206, and skin 1208.

Connecting bracket 1210 comprises first flange 1212 connected to skin 1208 of aircraft door 1202, second flange 1214 connected to beam 1206 of aircraft door 1202, and third flange 1216 connected to frame 1204 of aircraft door 1202. Connecting bracket 1210 is connected to aircraft door 1202 such that connecting bracket 1210 is connected inside of aircraft door 1202. Connecting bracket 1210 is configured such that the majority of connecting bracket 1210 is not visible from outside of the aircraft door.

As depicted, connecting bracket 1210 comprises three interface surfaces: first flange 1212, second flange 1214, and third flange 1216. In this illustrative example, the three interface surfaces are substantially mutually orthogonal. Second flange 1214 and third flange 1216 are both substantially planar. First flange 1212 is slightly contoured to match the shape of skin 1208.

The terms "approximately", "about", and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

Figure 13:
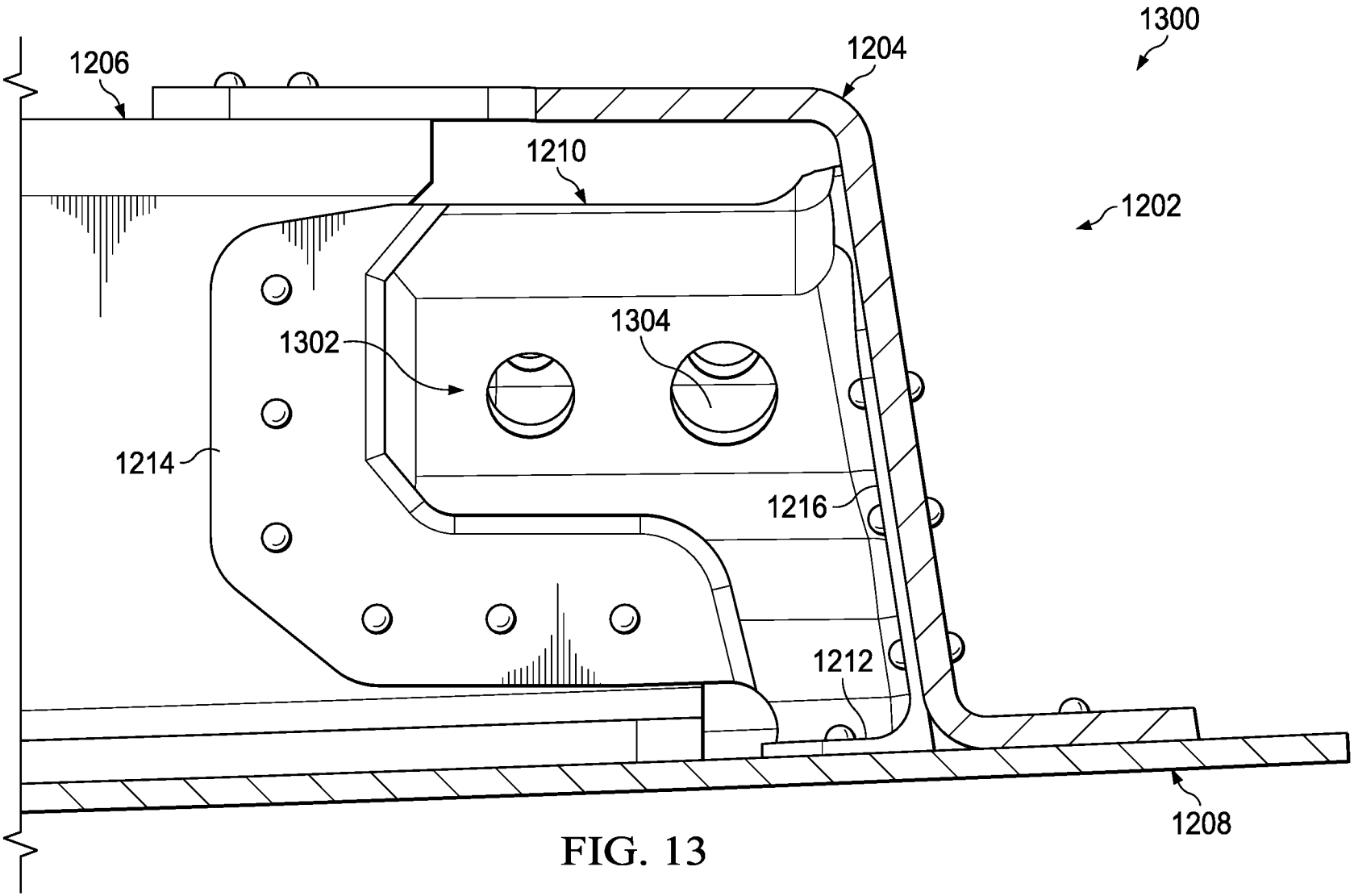
FIG. 13 is an illustration of a side view of a connecting bracket in an aircraft door in accordance with an illustrative embodiment.

Turning now to FIG. 13, an illustration of a side view of a connecting bracket in an aircraft door is depicted in accordance with an illustrative embodiment. View 1300 is a side view of aircraft door 1202 and connecting bracket 1210. Also visible in view 1300 is number of holes 1302. Number of holes 1302 extend through stop fitting receptacle 1304 of connecting bracket 1210. Number of holes 1302 are configured to receive removable fasteners to fasten a stop fitting (not depicted) in stop fitting receptacle 1304.

Figure 14:
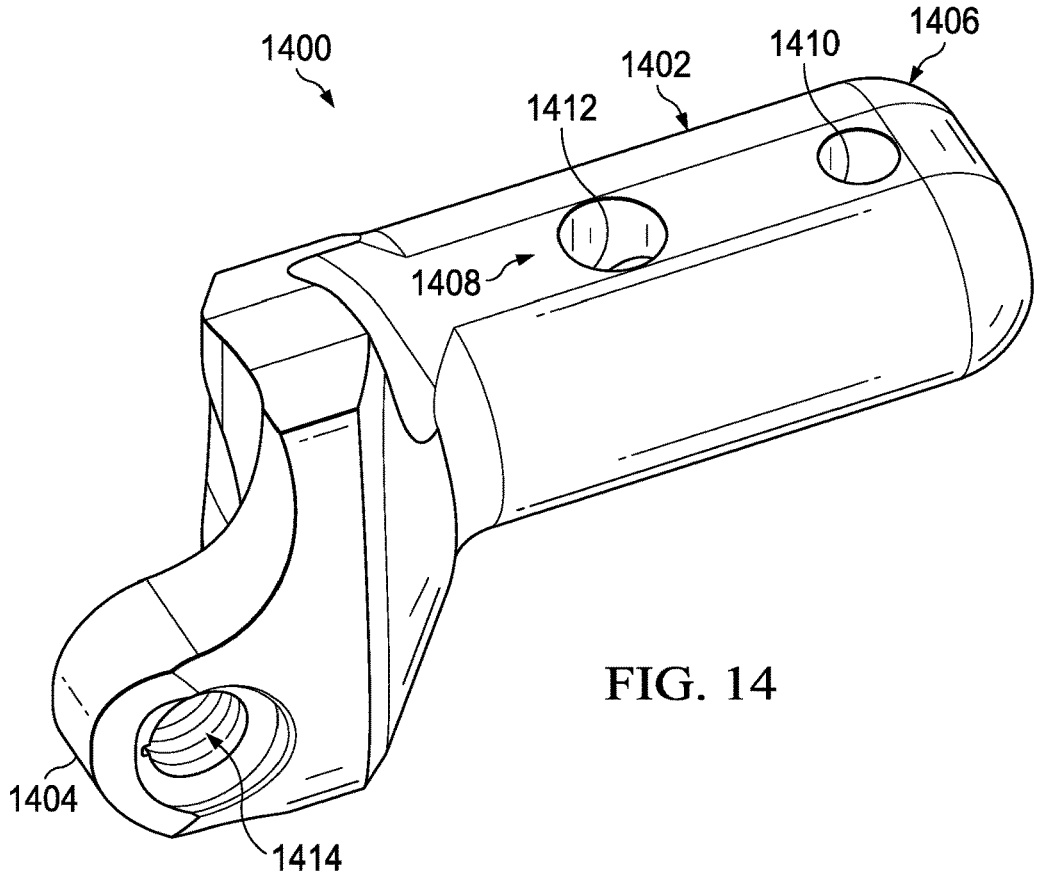
FIG. 14 is an illustration of an isometric view of a common stop fitting in accordance with an illustrative embodiment.

Turning now to FIG. 14, an illustration of an isometric view of a common stop fitting is depicted in accordance with an illustrative embodiment. Stop fitting 1400 is a physical implementation of one of plurality of stop fittings 214 of FIG. 2. Stop fitting 1400 can be a physical implementation of stop fitting 226 of FIGS. 2 and 3. Stop fitting 1400 can be used in any of plurality of stop fitting assemblies 412 of FIGS. 4-5. In some illustrative examples, stop fitting 1400 can have the same design as stop fitting 604 of FIGS. 6-11. In some illustrative examples, stop fitting 1400 can be used in conjunction with connecting bracket 1210 of FIGS. 12-13 to form a stop fitting assembly.

Stop fitting 1400 comprises shaft 1402 and flange 1404. Shaft 1402 has shape 1406 configured to be inserted into a stop fitting receptacle of a connecting bracket. Shape 1406 is selected to prevent rotation of shaft 1402 within the stop fitting receptacle. In some illustrative examples, shape 1406 is also selected based on machinability of shape 1406.

Number of holes 1408 extend through shaft 1402 of stop fitting 1400. Number of holes 1408 are present to receive a number of removable fasteners to fasten stop fitting 1400 within a stop fitting receptacle. In this illustrative example, number of holes 1408 includes hole 1410 and hole 1412 extending through shaft 1402.

Flange 1404 extends outwardly from shaft 1402. Pin interface hole 1414 extends through flange 1404. Pin interface hole 1414 is configured to receive a stop pin.

Figure 15:
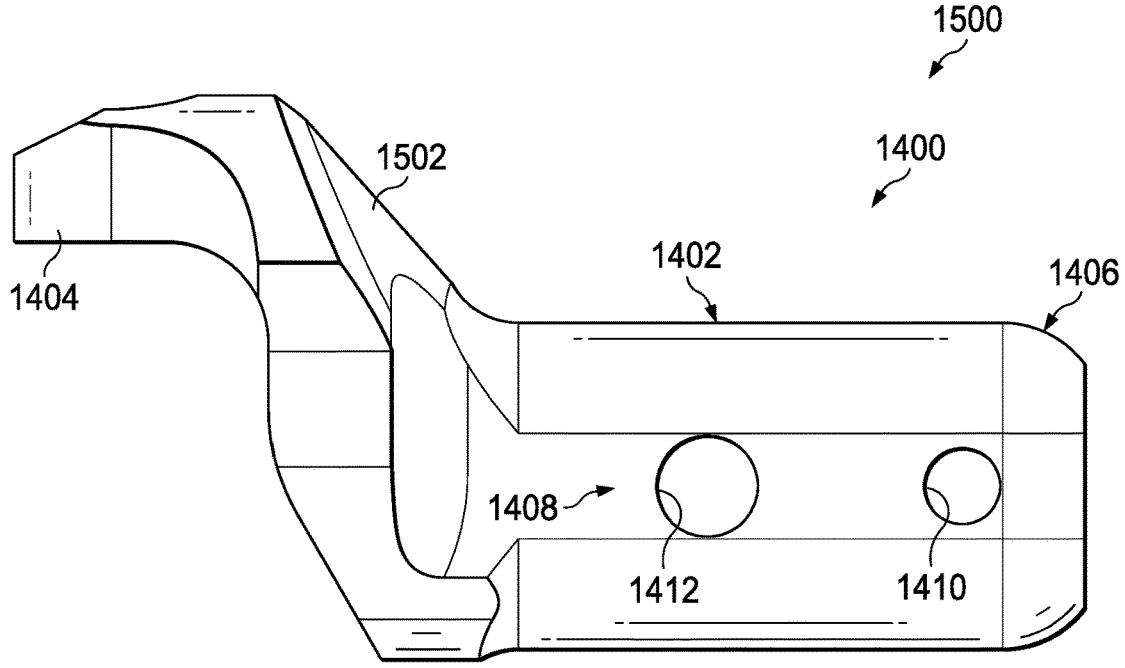
FIG. 15 is an illustration of a side view of a common stop fitting in accordance with an illustrative embodiment.

Turning now to FIG. 15, an illustration of a side view of a common stop fitting is depicted in accordance with an illustrative embodiment. In view 1500 number of holes 1408 extending through shaft 1402 is seen.

As can be seen in view 1500, flange 1404 extends outwardly parallel to but offset from shaft 1402. As can be seen in view 1500, transition section 1502 joins flange 1404 and shaft 1402.

Figure 16:
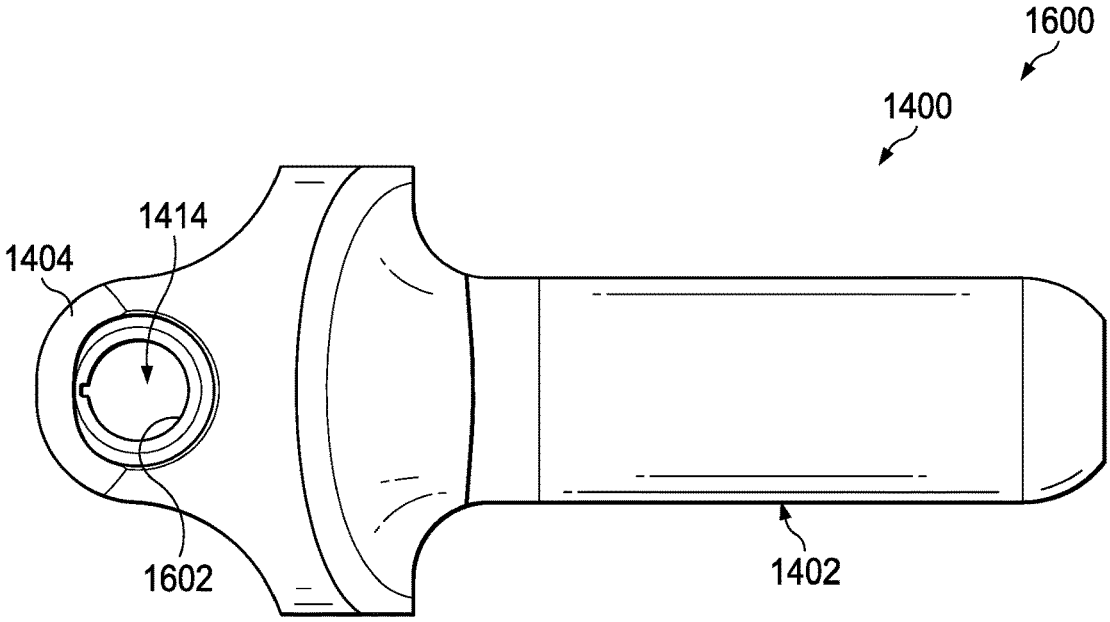
FIG. 16 is an illustration of a top view of a common stop fitting in accordance with an illustrative embodiment.

Turning now to FIG. 16, an illustration of a top view of a common stop fitting is depicted in accordance with an illustrative embodiment. In view 1600 threads 1602 of pin interface hole 1414 can be seen. Threads 1602 enable direct connection of stop fitting 1400 and a stop pin.

Figure 17:
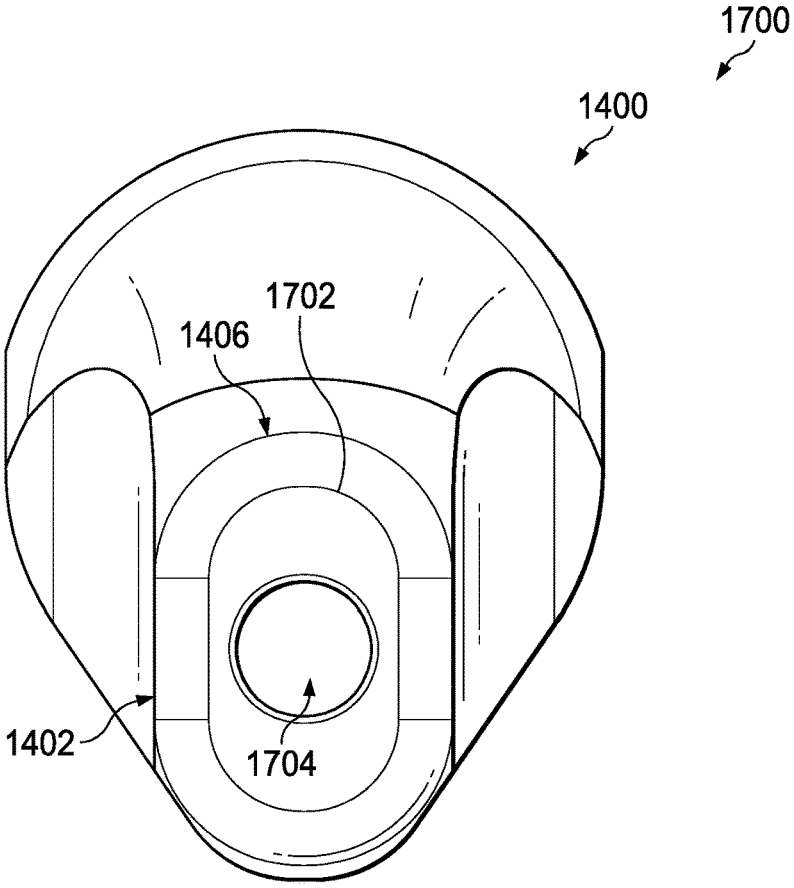
FIG. 17 is an illustration of a back view of a common stop fitting in accordance with an illustrative embodiment.

Turning now to FIG. 17, an illustration of a back view of a common stop fitting is depicted in accordance with an illustrative embodiment. In back view 1700 shape 1406 of shaft 1402 can be seen. As depicted, shape 1406 has cross-section 1702 that takes the form of an oval. Cross-section 1702 has been selected to restrict rotation of shaft 1402 in a stop fitting receptacle. In other illustrative examples, cross-section 1702 can take any desirable form. In some illustrative examples, cross-section 1702 is selected from another shape configured to restrict rotation, such as a square, a rectangle, a triangle, a pentagon, a hexagon, or any other desirable shape.

As depicted, channel 1704 extends through shaft 1402. Channel 1704 reduces weight of stop fitting 1400 compared to stop fitting 1400 without channel 1704. In some illustrative examples, stop fitting 1400 may be referred to as hollow due to channel 1704 extending through shaft 1402.

Figure 18:
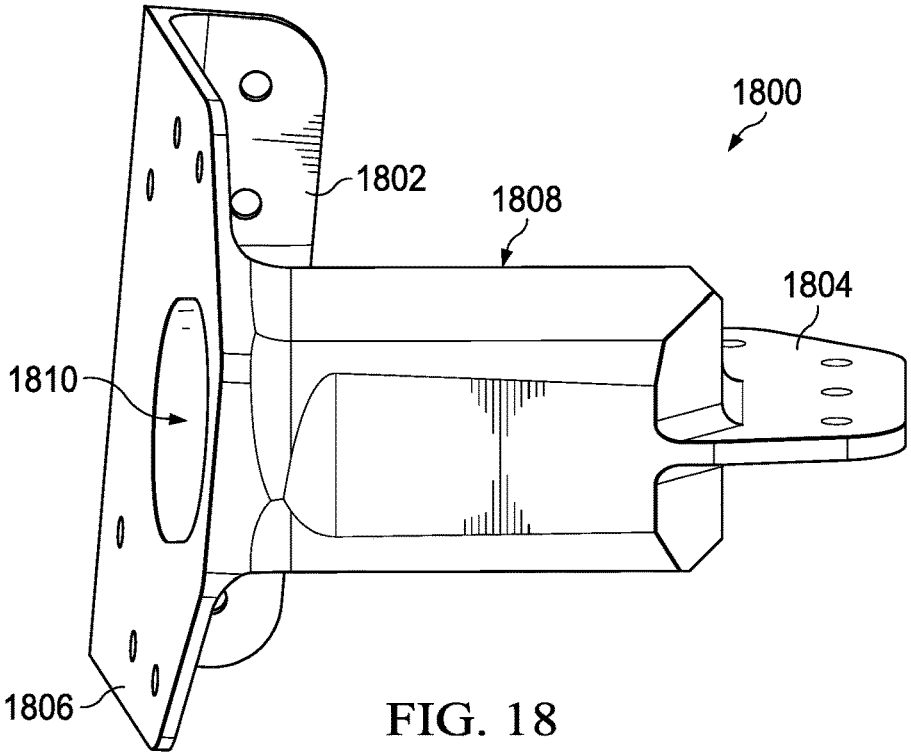
FIG. 18 is an illustration of a top view of a connecting bracket in accordance with an illustrative embodiment.

FIGS. 18-21 are views of an illustrative example of a connecting bracket. Turning now to FIG. 18, an illustration of a top view of a connecting bracket is depicted in accordance with an illustrative embodiment. Connecting bracket 1800 could be used in a stop fitting assembly on one of doors 120 of aircraft 100 of FIG. 1. Connecting bracket 1800 is a physical implementation of connecting bracket 230 of FIGS. 2 and 3. Connecting bracket 1800 could be used in one of plurality of stop fitting assemblies 412. In some illustrative examples, connecting bracket 1800 has a same design as connecting bracket 606 of FIGS. 6-9. In some illustrative examples, connecting bracket 1800 has a same design as connecting bracket 1210 of FIGS. 12-13.

Connecting bracket 1800 comprises first flange 1802 configured to be connected to a skin of an aircraft door, second flange 1804 configured to be connected to a beam of the aircraft door, and third flange 1806 configured to be connected to a frame of the aircraft door. Connecting bracket 1800 is configured to be connected to the aircraft door such that connecting bracket 1800 is connected inside of the aircraft door. Connecting bracket 1800 is configured such that the majority of connecting bracket 1800 is not visible from outside of the aircraft door.

Connecting bracket 1800 further comprises walls 1808 surrounding and forming stop fitting receptacle 1810. Stop fitting receptacle 1810 is configured to receive a shaft of a stop fitting such as stop fitting 1400 of FIGS. 14-17.

Figure 19:
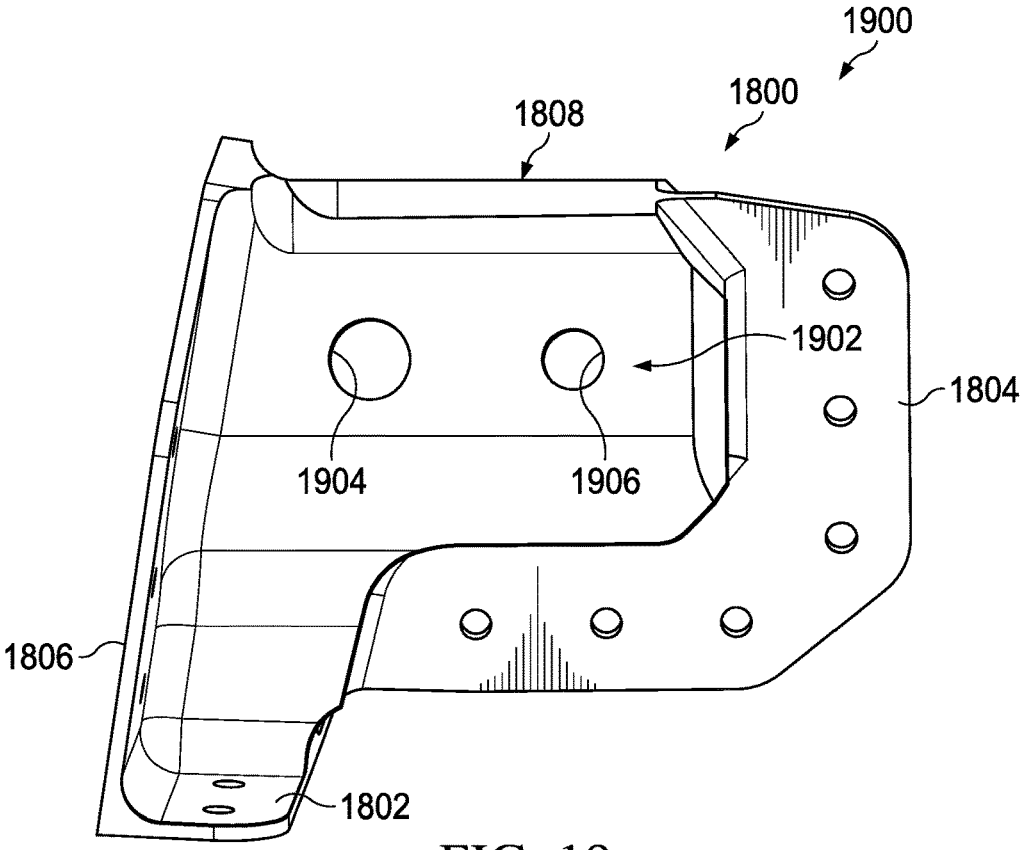
FIG. 19 is an illustration of a side view of a connecting bracket in accordance with an illustrative embodiment.

Turning now to FIG. 19, an illustration of a side view of a connecting bracket is depicted in accordance with an illustrative embodiment. View 1900 is a side view of connecting bracket 1800 of FIG. 18. In view 1900, number of holes 1902 extending through walls 1808 of connecting bracket 1800 is visible. As depicted, number of holes 1902 includes hole 1904 and hole 1906. Each of number of holes 1902 is configured to receive a removeable fastener to removably connect a stop fitting within stop fitting receptacle 1810.

Figure 20:
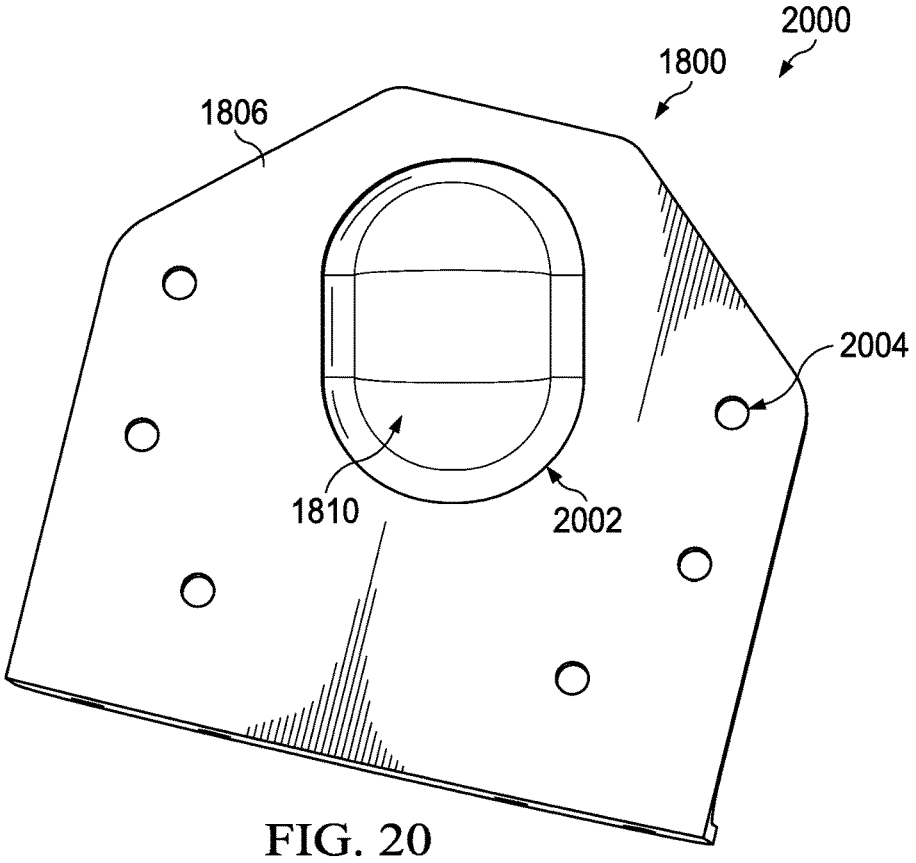
FIG. 20 is an illustration of a front view of a connecting bracket in accordance with an illustrative embodiment.

Turning now to FIG. 20, an illustration of a front view of a connecting bracket is depicted in accordance with an illustrative embodiment. View 2000 is a front view of connecting bracket 1800. In view 2000, stop fitting receptacle 1810 is visible. In this illustrative example, stop fitting receptacle 1810 has shape 2002 configured to receive a stop fitting. In this illustrative example, shape 2002 has an oval cross-section to receive a stop fitting with an oval cross-section. By stop fitting receptacle 1810 having an oval cross-section, a stop fitting (not depicted) within stop fitting receptacle 1810 will be restrained from rotation within stop fitting receptacle 1810 by shape 2002.

In view 2000, plurality of holes 2004 is visible. Plurality of holes 2004 extend through third flange 1806 and are configured to receive permanent fasteners to join connecting bracket 1800 to an aircraft door.

Figure 21:
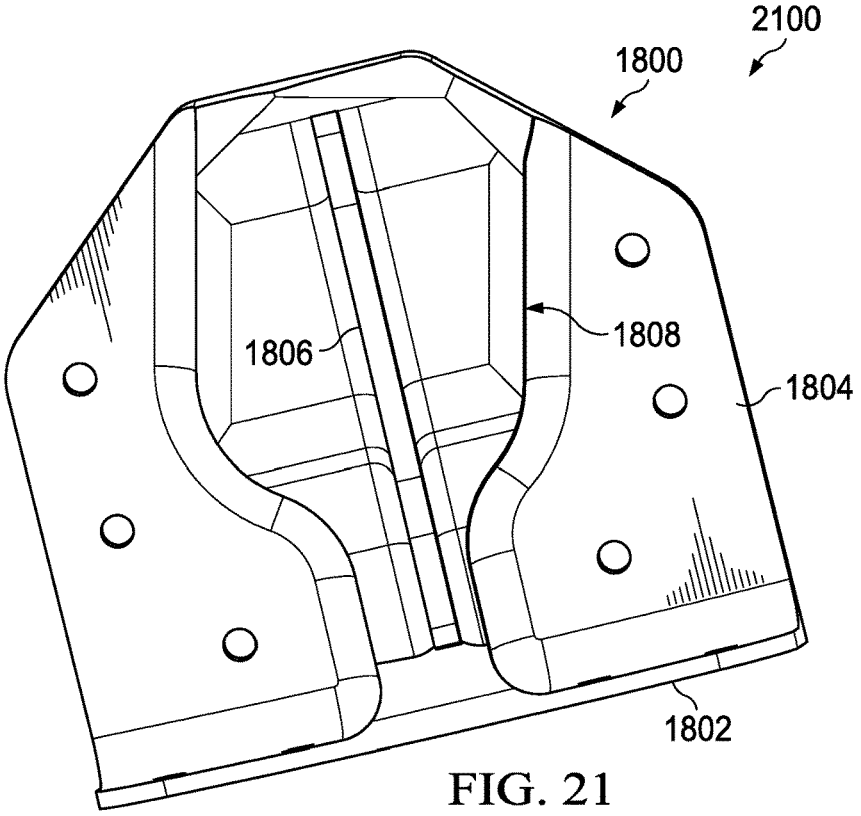
FIG. 21 is an illustration of a back view of a connecting bracket in accordance with an illustrative embodiment.

Turning now to FIG. 21, an illustration of a back view of a connecting bracket is depicted in accordance with an illustrative embodiment. In view 2100, a back view of connecting bracket 1800 is shown.

Figure 22A:
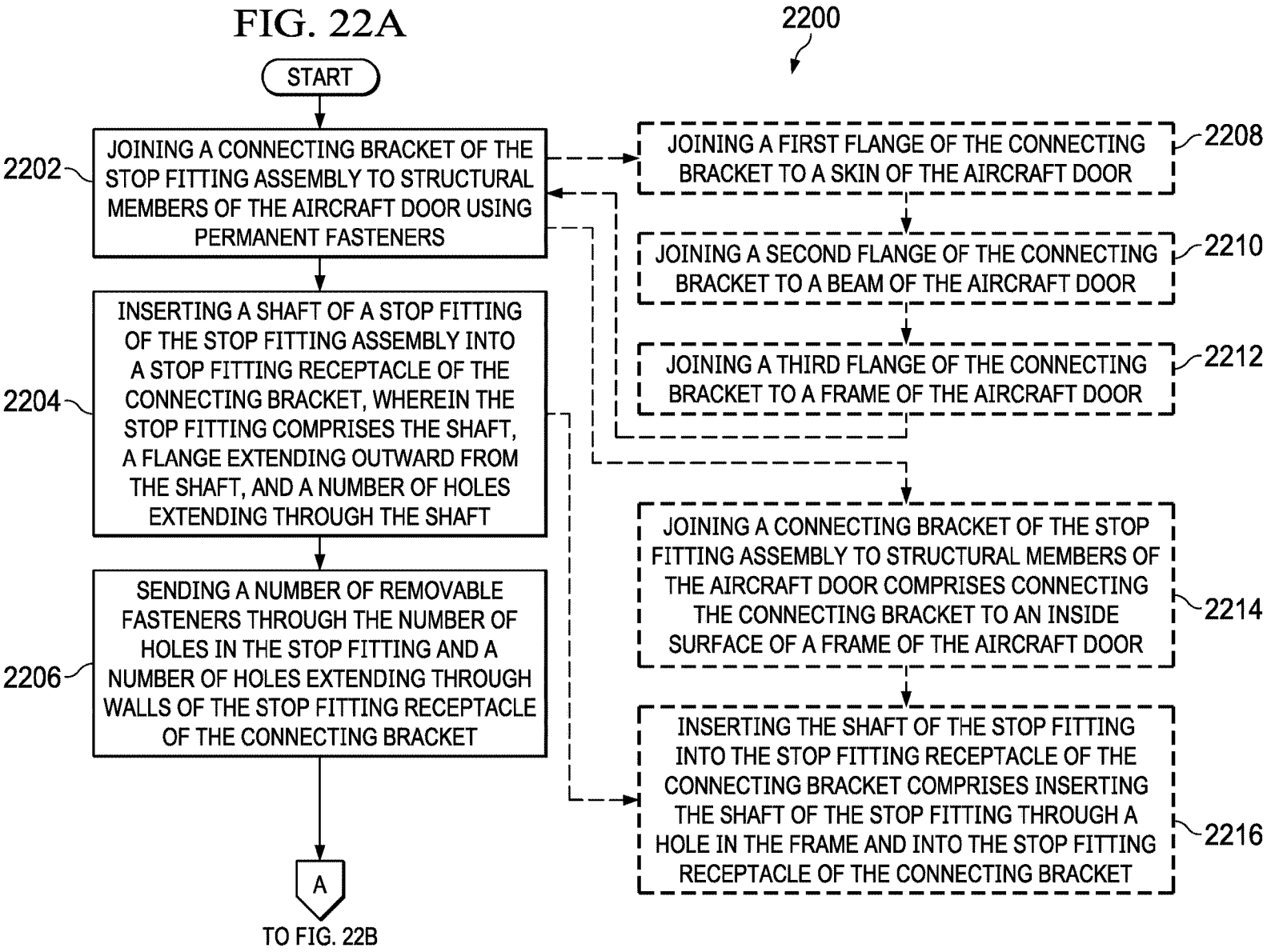
FIGS. 22A and 22B are an illustration of a flowchart of a method of installing a stop fitting assembly in an aircraft door in accordance with an illustrative embodiment.
Figure 22B:
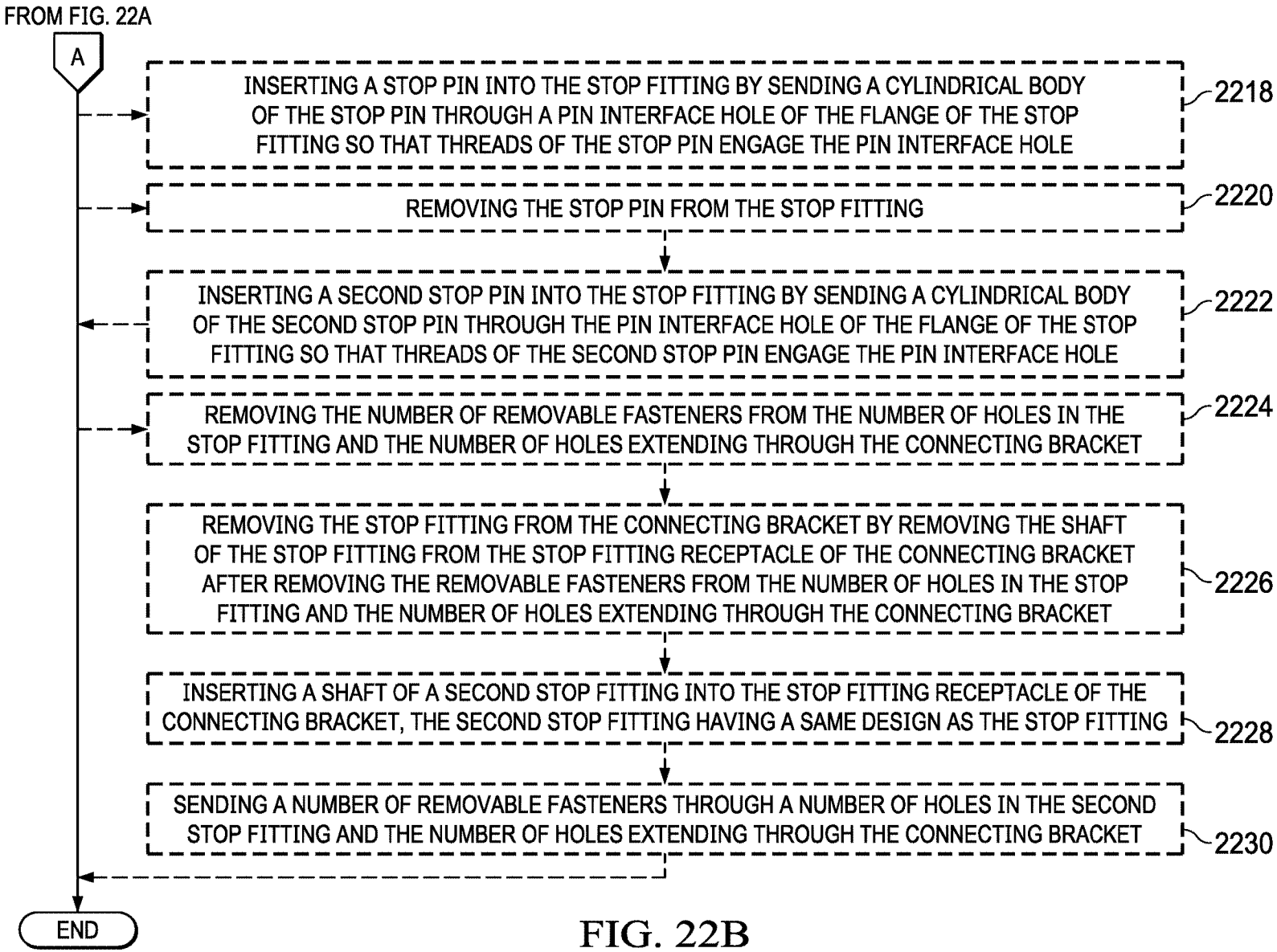

Turning now to FIGS. 22A and 22B, an illustration of a flowchart of a method of installing a stop fitting assembly in an aircraft door is depicted in accordance with an illustrative embodiment. Method 2200 can be used to install a stop fitting assembly in aircraft 100. Method 2200 can be used to install stop fitting assembly 222 or stop fitting assembly 224 in FIGS. 2 and 3. Method 2200 can be used to install a stop fitting assembly of plurality of stop fitting assemblies 412 of aircraft door 410 in FIGS. 4 and 5. Method 2200 can be used to install stop fitting assembly 602 in FIGS. 6-9. Any of stop fitting 604 of FIGS. 6-11, connecting bracket 1210 of FIGS. 12 and 13, stop fitting 1400 of FIGS. 14-17, or connecting bracket 1800 in FIGS. 18-21 can be used in performing method 2200.

Method 2200 installs a stop fitting assembly in an aircraft door. Method 2200 joins a connecting bracket of the stop fitting assembly to structural members of the aircraft door using permanent fasteners (operation 2202). Method 2200 inserts a shaft of a stop fitting of the stop fitting assembly into a stop fitting receptacle of the connecting bracket, wherein the stop fitting comprises the shaft, a flange extending outward from the shaft, and a number of holes extending through the shaft (operation 2204). Method 2200 sends a number of removable fasteners through the number of holes in the stop fitting and a number of holes extending through walls of the stop fitting receptacle of the connecting bracket (operation 2206). Afterwards method 2200 terminates.

In some illustrative examples joining the connecting bracket of the stop fitting assembly to the structural members of the aircraft door in operation 2202 comprises operations 2208 through 2212. In some illustrative examples, method 2200 joins a first flange of the connecting bracket to a skin of the aircraft door (operation 2208). In some illustrative examples, method 2200 joins a second flange of the connecting bracket to a beam of the aircraft door (operation 2210). In some illustrative examples, method 2200 joins a third flange of the connecting bracket to a frame of the aircraft door (operation 2212).

In some illustrative examples, joining a connecting bracket of the stop fitting assembly to structural members of the aircraft door comprises connecting the connecting bracket to an inside surface of a frame of the aircraft door (operation 2214). In some illustrative examples, inserting the shaft of the stop fitting into the stop fitting receptacle of the connecting bracket comprises inserting the shaft of the stop fitting through a hole in the frame and into the stop fitting receptacle of the connecting bracket (operation 2216).

In some illustrative examples, method 2200 further comprises inserting a stop pin into the stop fitting by sending a cylindrical body of the stop pin through a pin interface hole of the flange of the stop fitting so that threads of the stop pin engage the pin interface hole (operation 2218).

In some illustrative examples, method 2200 further comprises removing the stop pin from the stop fitting (operation 2220). In some illustrative examples, method 2200 further comprises inserting a second stop pin into the stop fitting by sending a cylindrical body of the second stop pin through the pin interface hole of the flange of the stop fitting so that threads of the second stop pin engage the pin interface hole (operation 2222).

In some illustrative examples, method 2200 further comprises removing the number of removable fasteners from the number of holes in the stop fitting and the number of holes extending through the connecting bracket (operation 2224). In some illustrative examples, method 2200 further comprises removing the stop fitting from the connecting bracket by removing the shaft of the stop fitting from the stop fitting receptacle of the connecting bracket after removing the number of removable fasteners from the number of holes in the stop fitting and the number of holes extending through the connecting bracket (operation 2226). In some illustrative examples, method 2200 further comprises inserting a shaft of a second stop fitting into the stop fitting receptacle of the connecting bracket, the second stop fitting having a same design as the stop fitting (operation 2228). In some illustrative examples, method 2200 further comprises sending removable fasteners through a number of holes in the second stop fitting and the number of holes extending through the connecting bracket (operation 2230).

In some illustrative examples, the stop fitting assembly is one of a plurality of stop fitting assemblies, wherein the connecting bracket is one of a plurality of connecting brackets of the plurality of stop fitting assemblies, and wherein each of the plurality of connecting brackets has a respective design configured for a selected location of the aircraft door.

Figure 23:
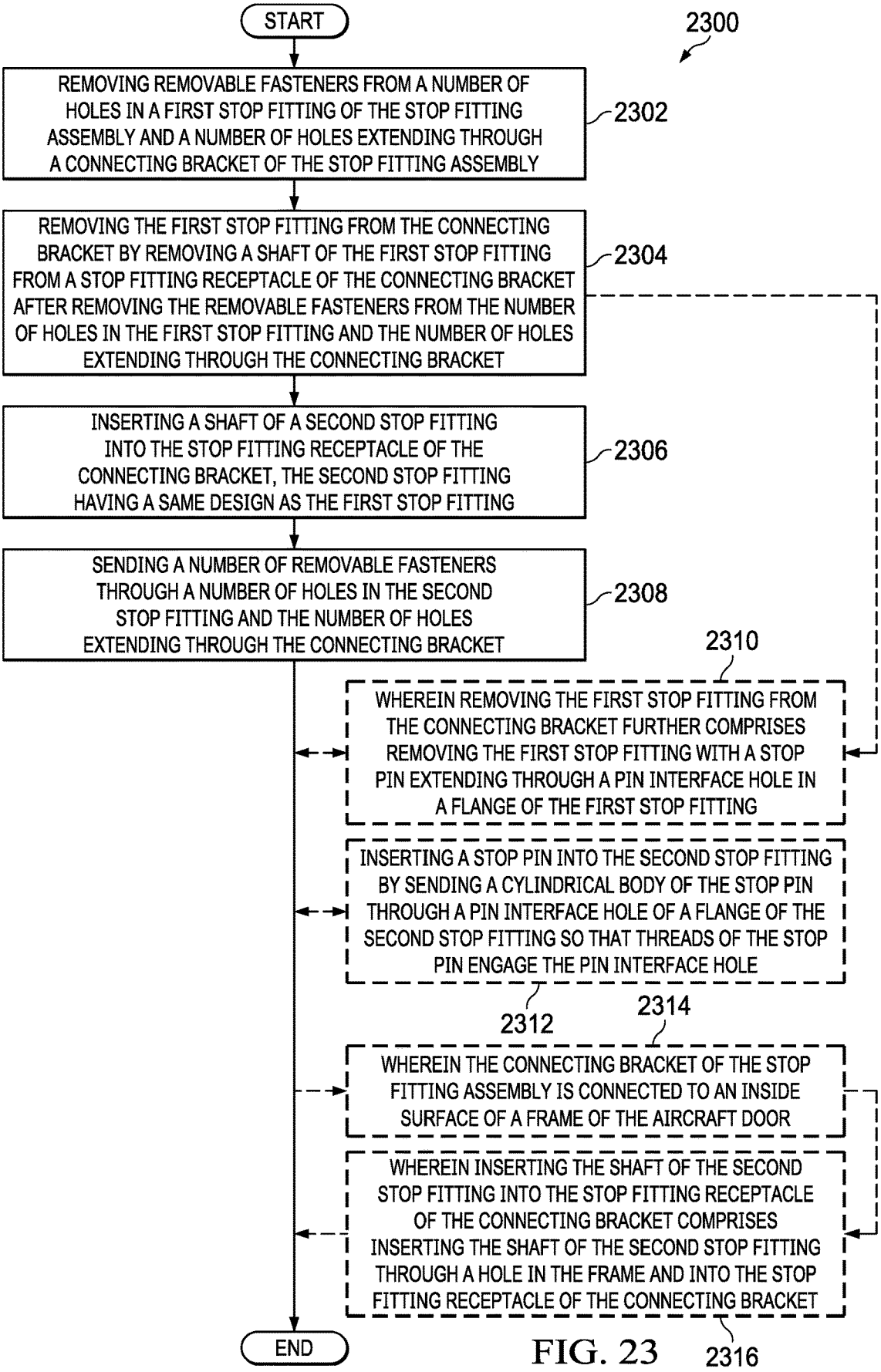
FIG. 23 is an illustration of a flowchart of a method of maintaining a stop fitting assembly in an aircraft door in accordance with an illustrative embodiment.

Turning now to FIG. 23, an illustration of a flowchart of a method of maintaining a stop fitting assembly in an aircraft door is depicted in accordance with an illustrative embodiment. Method 2300 can be used to maintain a stop fitting assembly in aircraft 100. Method 2300 can be used to maintain stop fitting assembly 222 or stop fitting assembly 224 in FIGS. 2 and 3. Method 2300 can be used to maintain a stop fitting assembly of plurality of stop fitting assemblies 412 of aircraft door 410 in FIGS. 4 and 5. Method 2300 can be used to maintain stop fitting assembly 602 in FIGS. 6-9. Any of stop fitting 604 of FIGS. 6-11, connecting bracket 1210 of FIGS. 12 and 13, stop fitting 1400 of FIGS. 14-17, or connecting bracket 1800 in FIGS. 18-21 can be used in maintaining method 2300.

Method 2300 maintains a stop fitting assembly in an aircraft door. Method 2300 removes removable fasteners from a number of holes in a first stop fitting of the stop fitting assembly and a number of holes extending through a connecting bracket of the stop fitting assembly (operation 2302). Method 2300 removes the first stop fitting from the connecting bracket by removing a shaft of the first stop fitting from a stop fitting receptacle of the connecting bracket after removing the removable fasteners from the number of holes in the first stop fitting and the number of holes extending through the connecting bracket (operation 2304). Method 2300 inserts a shaft of a second stop fitting into the stop fitting receptacle of the connecting bracket, the second stop fitting having a same design as the first stop fitting (operation 2306). Method 2300 sends a number of removable fasteners through a number of holes in the second stop fitting and the number of holes extending through the connecting bracket (operation 2308). Afterwards method 2300 terminates.

In some illustrative examples, removing the first stop fitting from the connecting bracket further comprises removing the first stop fitting with a stop pin extending through a pin interface hole in a flange of the first stop fitting (operation 2310). In some illustrative examples, method 2300 inserts a stop pin into the second stop fitting by sending a cylindrical body of the stop pin through a pin interface hole of a flange of the second stop fitting so that threads of the stop pin engage the pin interface hole (operation 2312).

In some illustrative examples, the connecting bracket of the stop fitting assembly is connected to an inside surface of a frame of the aircraft door (operation 2314). In some illustrative examples, inserting the shaft of the second stop fitting into the stop fitting receptacle of the connecting bracket comprises inserting the shaft of the second stop fitting through a hole in the frame and into the stop fitting receptacle of the connecting bracket (operation 2316). As used herein, the phrase "at least one of," when used with a list of items, means different combinations of one or more of the listed items may be used and only one of each item in the list may be needed. For example, "at least one of item A, item B, or item C" may include, without limitation, item A, item A and item B, or item B. This example also may include item A, item B, and item C or item B and item C. Of course, any combinations of these items may be present. In other examples, "at least one of" may be, for example, without limitation, two of item A; one of item B; and ten of item C; four of item B and seven of item C; or other suitable combinations. The item may be a particular object, thing, or a category. In other words, at least one of means any combination items and number of items may be used from the list but not all of the items in the list are required.

As used herein, "a number of," when used with reference to items means one or more items.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram. Some blocks may be optional. For example, any of operation 2208 through operation 2230 may be optional. As another example, any of operation 2310 through operation 2316 may be optional.

Figure 24:
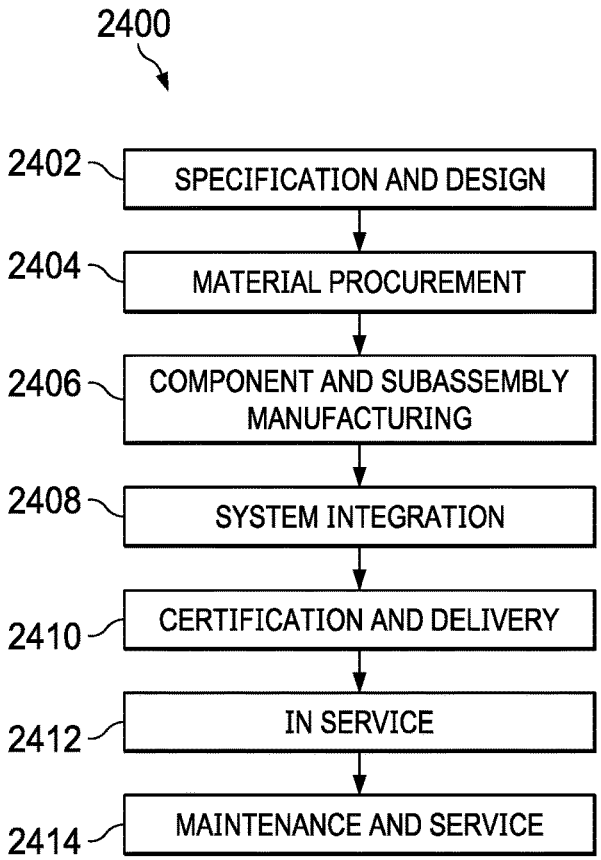
FIG. 24 is an illustration of an aircraft manufacturing and service method in a form of a block diagram in accordance with an illustrative embodiment.
Figure 25:
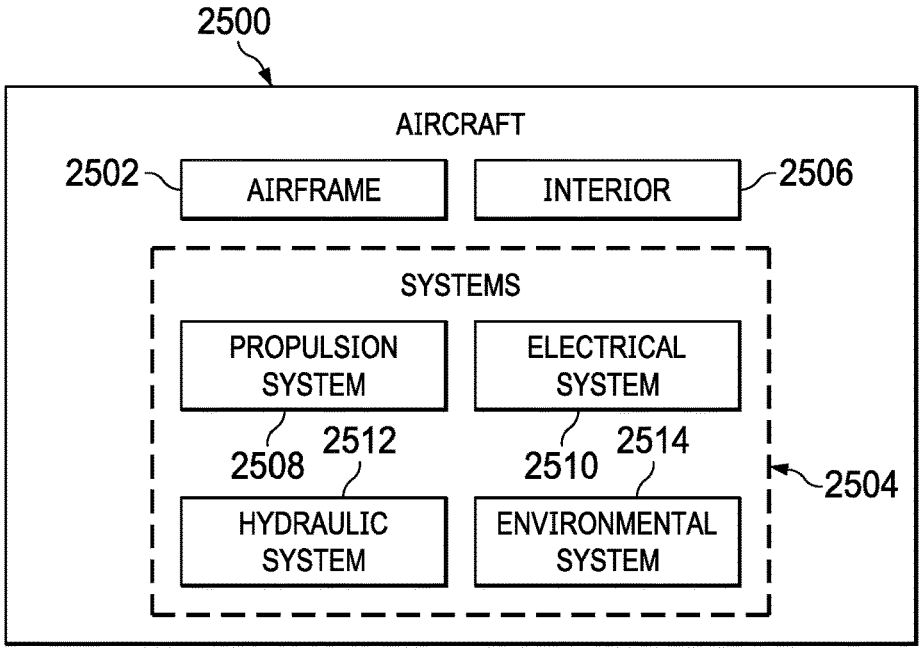
FIG. 25 is an illustration of an aircraft in a form of a block diagram in which an illustrative embodiment may be implemented.

Illustrative embodiments of the present disclosure may be described in the context of aircraft manufacturing and service method 2400 as shown in FIG. 24 and aircraft 2500 as shown in FIG. 25. Turning first to FIG. 24, an illustration of an aircraft manufacturing and service method is depicted in accordance with an illustrative embodiment. During preproduction, aircraft manufacturing and service method 2400 may include specification and design 2402 of aircraft 2500 in FIG. 25 and material procurement 2404.

During production, component and subassembly manufacturing 2406 and system integration 2408 of aircraft 2500 takes place. Thereafter, aircraft 2500 may go through certification and delivery 2410 in order to be placed in service 2412. While in service 2412 by a customer, aircraft 2500 is scheduled for routine maintenance and service 2414, which may include modification, reconfiguration, refurbishment, or other maintenance and service.

Each of the processes of aircraft manufacturing and service method 2400 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 25, an illustration of an aircraft is depicted in which an illustrative embodiment may be implemented. In this example, aircraft 2500 is produced by aircraft manufacturing and service method 2400 of FIG. 24 and may include airframe 2502 with plurality of systems 2504 and interior 2506. Examples of systems 2504 include one or more of propulsion system 2508, electrical system 2510, hydraulic system 2512, and environmental system 2514. Any number of other systems may be included.

Apparatuses and methods embodied herein may be employed during at least one of the stages of aircraft manufacturing and service method 2400. One or more illustrative embodiments may be manufactured or used during at least one of component and subassembly manufacturing 2406, system integration 2408, in service 2412, or maintenance and service 2414 of FIG. 24.

Stop fitting assemblies, such as stop fitting assembly 222 of FIG. 2 can be assembled during component and subassembly manufacturing 2406. Stop fitting assemblies, such as stop fitting assembly 222 are used to transfer aircraft door loads during in service 2412. A stop fitting, such as stop fitting 226, can be removed and replaced during maintenance and service 2414. A stop pin, such as stop pin 228, can be removed and replaced during maintenance and service 2414. Method 2200 can be performed during component and subassembly manufacturing 2406. Method 2300 can be performed during maintenance and service 2414.

Stop fitting assemblies, such as stop fitting assembly 222 of FIG. 2 can be implemented in aircraft 2500. Stop fitting assemblies, such as stop fitting assembly 222 of FIG. 2 can be part of airframe 2502.

The illustrative examples present a simple, replaceable stop fitting with symmetric shaft. (Steel or Titanium) The stop fitting includes threaded interface for adjustable stop pin-pad. The stop pin is the contact point between the door stop and the fuselage stop where door pressure loads transfer into the fuselage. The stop pin is adjustable to accommodate fairing the door outer surface to the fuselage outer surface. The monolithic connecting bracket provides a stop Fitting receptacle.

The connecting bracket can be installed with significantly less shimming that conventional stop fittings. Connecting bracket has nominally shim-less installation. The illustrative examples provide easy maintenance accessibility/replaceability. The use of replaceable fasteners reduces the difficulty and time of removing and replacing components of the stop fitting assembly compared to a conventional stop fitting.

The stop fitting assembly design is optimized for integration with CFRP door structure.

The illustrative examples incorporate a common, easily replaced stop fitting that fits into a single connecting bracket which is rigidly assembled to the door structure. The illustrative examples are simpler, cheaper to manufacture, cheaper to assemble and cheaper to maintain over the life of the airplane than conventional stop fittings.

The illustrative examples are an enhancement over existing designs as they use fewer unique parts while utilizing a common stop fitting for all locations. The illustrative examples are easier to install due to reduced shimming requirements and lower part count. The illustrative examples are easier to maintain due to easily replaceable components.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A stop fitting assembly for an aircraft door, the stop fitting assembly comprising:

a stop fitting having a shaft, a flange extending outward from the shaft, and a number of holes extending through the shaft;

a connecting bracket having a stop fitting receptacle configured to receive the shaft of the stop fitting, a number of holes extending through walls of the stop fitting receptacle, the connecting bracket configured to be joined to structural members of the aircraft door;

a plurality of removable fasteners configured to pass through a number of holes in the stop fitting and the number of holes of the stop fitting receptacle to removably join the stop fitting and the connecting bracket; and a plurality of permanent fasteners extending through a number of flanges of the connecting bracket to join the stop fitting assembly to the aircraft door, wherein the shaft has a non-circular shape configured to prevent rotation of the shaft within the stop fitting receptacle when the plurality of removable fasteners are absent.

2. The stop fitting assembly of claim 1 further comprising:

a stop pin extending through a pin interface hole of the flange of the stop fitting.

3. The stop fitting assembly of claim 2, wherein the pin interface hole is threaded, and wherein the stop pin has threads directly engaging the pin interface hole.

4. The stop fitting assembly of claim 1, wherein the stop fitting is monolithic.

5. The stop fitting assembly of claim 1, wherein the connecting bracket is monolithic.

6. The stop fitting assembly of claim 1, wherein the connecting bracket is one of a plurality of connecting brackets for a plurality of stop fitting assemblies of the aircraft door, and wherein each connecting bracket of the plurality of connecting brackets has a respective design for a select location on the aircraft door.

7. The stop fitting assembly of claim 6, wherein the stop fitting is one of a plurality of stop fittings for the plurality of stop fitting assemblies of the aircraft door, and wherein each of the plurality of stop fittings has a same design.

8. An apparatus, comprising:

a stop fitting having a shaft, a flange extending outward from the shaft, and a number of holes extending through the shaft;

a connecting bracket having a stop fitting receptacle configured to receive the shaft of the stop fitting, a number of holes extending through walls of the stop fitting receptacle, the connecting bracket configured to be joined to structural members of an aircraft door;

a plurality of removable fasteners configured to pass through a number of holes in the stop fitting and the number of holes of the stop fitting receptacle to removably join the stop fitting and the connecting bracket; and a plurality of permanent fasteners extending through a number of flanges of the connecting bracket to join the stop fitting to the aircraft door, wherein the shaft has a non-circular shape configured to prevent rotation of the shaft within the stop fitting receptacle when the plurality of removable fasteners are absent.

9. The apparatus of claim 8 further comprising:

a stop pin extending through a pin interface hole of the flange of the stop fitting.

10. The apparatus of claim 9, wherein the pin interface hole is threaded, and wherein the stop pin has threads directly engaging the pin interface hole.

11. The apparatus of claim 8, wherein the stop fitting is monolithic.

12. The apparatus of claim 8, wherein the connecting bracket is monolithic.

13. The apparatus of claim 8, wherein the connecting bracket is one of a plurality of connecting brackets for a plurality of stop fitting assemblies of the aircraft door, and wherein each connecting bracket of the plurality of connecting brackets has a respective design for a select location on the aircraft door.

14. The apparatus of claim 13, wherein the stop fitting is one of a plurality of stop fittings for the plurality of stop fitting assemblies of the aircraft door, and wherein each of the plurality of stop fittings has a same design.

15. An apparatus, comprising:

a stop fitting having a shaft, a flange extending outward from the shaft, and a number of holes extending through the shaft;

a connecting bracket having a stop fitting receptacle configured to receive the shaft of the stop fitting, a number of holes extending through walls of the stop fitting receptacle, the connecting bracket configured to be joined to structural members of an aircraft door; and a plurality of removable fasteners configured to pass through a number of holes in the stop fitting and the number of holes of the stop fitting receptacle to removably join the stop fitting and the connecting bracket, wherein the shaft has a non-circular shape configured to prevent rotation of the shaft within the stop fitting receptacle when the plurality of removable fasteners are absent.

16. The apparatus of claim 15 further comprising:

a stop pin extending through a pin interface hole of the flange of the stop fitting.

17. The apparatus of claim 16, wherein the pin interface hole is threaded, and wherein the stop pin has threads directly engaging the pin interface hole.

18. The apparatus of claim 15, wherein the stop fitting is monolithic.

19. The apparatus of claim 15, wherein the connecting bracket is monolithic.

20. The apparatus of claim 15, wherein the connecting bracket is one of a plurality of connecting brackets for a plurality of stop fitting assemblies of the aircraft door, and wherein each connecting bracket of the plurality of connecting brackets has a respective design for a select location on the aircraft door.

21. The apparatus of claim 20, wherein the stop fitting is one of a plurality of stop fittings for the plurality of stop fitting assemblies of the aircraft door, and wherein each of the plurality of stop fittings has a same design.

22. The apparatus of claim 15, further comprising a plurality of permanent fasteners extending through a number of flanges of the connecting bracket to join the stop fitting to the aircraft door.

* * * * *